US012637246B2

(12) United States Patent
Mcmahan et al.

(10) Patent No.: US 12,637,246 B2
(45) Date of Patent: May 26, 2026

(54) SYSTEMS AND METHODS FOR AUTOMATED PACKAGING AND PROCESSING CONTAINERS FOR SHIPPING WITH PLACE STACK TRANSFER MANAGEMENT

(71) Applicant: Berkshire Grey Operating Company, Inc., Bedford, MA (US)

(72) Inventors: William Chu-Hyon Mcmahan, North Cambridge, MA (US); Bretton Anderson, Westford, MA (US); Timothy John Longo, Pembroke, MA (US); Chad Karl Tobler, Cranberry Township, PA (US); Gene Temple Price, Somerville, MA (US)

(73) Assignee: Berkshire Grey Operating Company, Inc., Bedford, MA (US)

( * ) Notice: Subject to any disclaimer, the term of this patent is extended or adjusted under 35 U.S.C. 154(b) by 0 days.

(21) Appl. No.: 19/040,978

(22) Filed: Jan. 30, 2025

(65) Prior Publication Data

US 2025/0250050 A1 Aug. 7, 2025

Related U.S. Application Data

(60) Provisional application No. 63/710,834, filed on Oct. 23, 2024, provisional application No. 63/548,983, filed on Feb. 2, 2024.

(51) Int. Cl.
*B65B 43/54* (2006.01)
*B65B 5/08* (2006.01)
(Continued)

(52) U.S. Cl.
CPC ..... *B65B 43/54* (2013.01); *B65B 5/08* (2013.01); *B65B 35/14* (2013.01); *B65B 57/10* (2013.01)

(58) Field of Classification Search
CPC ..... B65B 35/14; B65B 35/16; B65B 43/52; B65B 43/54; B65B 5/08; B65B 57/10; B65G 13/10; B65G 2207/34; B65G 47/54
See application file for complete search history.

(56) References Cited

U.S. PATENT DOCUMENTS 4,541,520 A * 9/1985 Greenlee, III ..... B65G 13/07 198/584
2007/0221471 A1* 9/2007 Fourney ..... B65G 17/24 198/779

(Continued)

FOREIGN PATENT DOCUMENTS

| | | | |
|---|---|---|---|
| CA | 3199771 | A1 | 5/2022 |
| CN | 116443349 | A | 7/2023 |
| CN | 116583381 | A | 8/2023 |

OTHER PUBLICATIONS

International Search Report and Written Opinion of the International Searching Authority, the European Patent Office, issued in related international application No. PCT/US2025/013679 on Jun. 18, 2025, 11 pages.

*Primary Examiner* — Himchan Song
(74) *Attorney, Agent, or Firm* — Gesmer Updegrove LLP

(57) ABSTRACT

An automated packing system for placing at least one object into a container is disclosed. The automated packing system includes an input conveyance system for providing empty containers to a packing station, a multidirectional unit at the packing station for receiving the container and for urging the container against a corner provided by two braces, a programmable motion device for packing the container with objects provided by source containers, and an output conveyance system for receiving the container from the multidirectional unit following packing.

24 Claims, 18 Drawing Sheets

(51) Int. Cl.
*B65B 35/14* (2006.01)
*B65B 57/10* (2006.01)

(56) References Cited

U.S. PATENT DOCUMENTS

| | | | | |
|---|---|---|---|---|
| 2008/0190075 | A1* | 8/2008 | Waeckerlin | B65B 65/003 53/273 |
| 2020/0062514 | A1* | 2/2020 | Dugat | B65G 47/54 |
| 2020/0122936 | A1* | 4/2020 | Bennett | B65B 35/54 |
| 2021/0053776 | A1* | 2/2021 | Mehendale | B65G 47/682 |
| 2024/0001536 | A1* | 1/2024 | Wagner | B65G 47/766 |
| 2024/0300722 | A1* | 9/2024 | Alpine | B65B 55/00 |
| 2025/0083905 | A1* | 3/2025 | Karpov | B65G 13/10 |

* cited by examiner

SYSTEMS AND METHODS FOR AUTOMATED PACKAGING AND PROCESSING CONTAINERS FOR SHIPPING WITH PLACE STACK TRANSFER MANAGEMENT

PRIORITY

The present application claims priority to U.S. Provisional Patent Application 63/548,983, filed Feb. 2, 2024, and U.S. Provisional Patent Application 63/710,834, filed Oct. 23, 2024, the disclosure of each of which is hereby incorporated by reference in its entirety.

BACKGROUND

The invention generally relates to automated sortation and other processing systems, and relates in particular to automated systems for packaging objects such as parcels, packages, articles, goods etc. for shipment.

Shipment centers for packaging and shipping a limited range of goods, for example, from a source company that manufactures the goods, may require only systems and processes that accommodate the limited range of the same goods repeatedly. Third party shipment centers on the other hand, that receive a wide variety of goods, must utilize systems and processes that may accommodate the wide variety of goods.

In e-commerce order fulfillment centers, for example, human personnel pack units of goods into shipping containers like boxes or polybags. One of the last steps in an order fulfillment center is packing one or more goods into a shipping container. Units of an order destined for a customer are typically packed by hand at pack stations. Order fulfillment centers do this for a number of reasons.

First, units need to be packed in shipping materials. For most items it is insufficient to put a shipping label on the unit and put it in the mail. Units need to be put in boxes or bags to protect the item. Second, units are not generally stored in the materials they are shipped in; they are not typically just ready to go out the dock door. Such units need to be packed on-the-fly after an order for the item has come in, otherwise if they were packed as they are shipped, space utilization in the warehouse would be inefficient.

Third, multiple units destined for the same customer are packed together to reduce shipping costs. The marginal cost of adding a single unit to a box is usually many times lower than creating a new box for the single unit. Fourth, consolidating the pack operation at pack stations improves the efficiency of the warehouse. The human personnel doing the packing do not walk around picking from shelves, they just focus on packing as many units per hour as possible.

Each of these requirements become more challenging as the number of goods and the number of destination locations increase. There is a need therefore, for an automated system for packing objects in preparation for shipping.

Certain automated systems for packing objects in preparation for shipping may further encounter additional challenges with regard to handling the shipping containers (such as cardboard boxes). Many such facilities may also require that a variety of sizes of such shipping containers be processed. When such containers are empty, they are lightweight and may be prone to tipping when having items packed into them, particularly when such automated systems are being operated to achieve a high throughput.

There is a need therefore for improved systems and methods for processing containers for shipping.

BRIEF DESCRIPTION OF THE DRAWINGS

The following description may be further understood with reference to the accompanying drawings in which.

Figure 1:
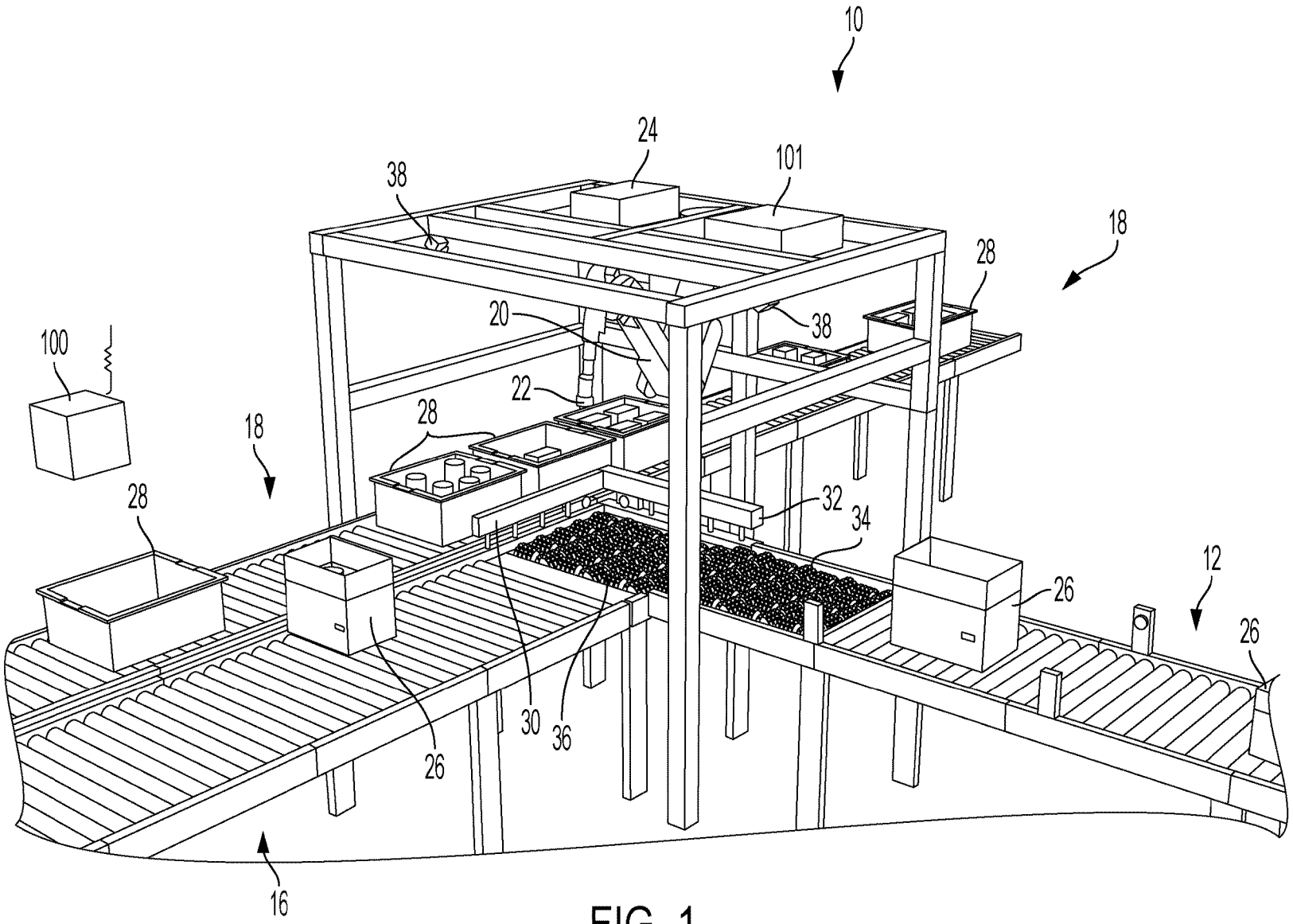
FIG. 1 shows an illustrative diagrammatic view of an object processing system in accordance with an aspect of the present invention.

The drawings are shown for illustrative purposes only.

SUMMARY

In accordance with an aspect the invention provides an automated packing system for placing at least one object into a container. The automated packing system includes an input conveyance system for providing empty containers to a packing station, a multidirectional unit at the packing station for receiving the container and for urging the container against a corner provided by two braces, a programmable motion device for packing the container with objects provided by source containers, and an output conveyance system for receiving the container from the multidirectional unit following packing.

In accordance with another aspect the invention provides an automated packing system for placing at least one object into a container. The automated packing system includes an input conveyance system for providing empty containers to a packing station, a multidirectional unit at the packing station for receiving the container and for urging the container against a corner that includes a pneumatic system for securing the container, a programmable motion device for packing the container with objects provided by source containers, and an output conveyance system for receiving the container from the multidirectional unit following packing.

In accordance with a further aspect the invention provides a method of placing at least one object into a container in an automated packing system. The method includes providing container on an input conveyance system to a packing station, receiving the container at a multidirectional unit at the packing station, urging the container against a corner provided by two braces, packing the container with objects provided by source containers using a programmable motion device, and receiving the container at an output conveyance system from the multidirectional unit following packing.

DETAILED DESCRIPTION

In accordance with various aspects, the invention provides systems and methods for robotically packing shipping containers, whether boxes, or cardboard trays, or some other physical container that holds one or more units of goods in preparation for shipping the objects. Applicant has discovered that there is a need for a robotic system that is able to quickly receive a lightweight box from a variety of positions, secure the lightweight box for packing, pack the box, and move the packed box along an output path.

Systems in accordance with various aspects include a multidirectional conveyor section that drives a box into a secure location (e.g., a corner location) to localize the box. In accordance with an aspect, the box is driven into vacuum cups that hold the box in place and prevent accidental box topping. The combination allows the system to support a wide variety of different box sizes. Throughput speed is maintained in certain aspects by minimizing or avoiding having moving parts hold the different size boxes at the packing locations that is referred to herein a place stack. The place stack is also mounted on a weight sensing system (e.g., using load cells) to enable pick verification in accordance with certain aspects of the present invention. The weight of the portion of the multidirectional conveyor that sits on the weight sensing system will be adjusted for, as will the weight of each box during processing.

With reference to FIG. 1, an object processing system 10 in accordance with an aspect of the present invention includes an input conveyance system 12 that is directed to a workstation with a place stack area 14, and an output conveyance system 16 that conveys packed boxes away from the workstation. A source conveyor 18 provides the source objects (e.g., in input containers 28) for packing to the workstation. A programmable motion device (such as a robotic arm) 20 is provided at the workstation and includes an end-effector with, for example a vacuum cup 22 that is provided at vacuum pressure by being coupled to a vacuum source 24. The empty containers 26 on the input conveyance system 12 may be received in a variety of orientations and positions on the input conveyance system 12. After each container 26 has been packed, it is ejected from the place stack and provided on the output conveyance system 16. The functionality and operation of all aspects of the system may be provided by one or more computer processing systems 100, 101. In accordance with various aspects (as discussed below in more detail), the system may employ weight sensing as objects are placed in the container for error detection. Systems may also use scan-on-hand for item identification and pose detection.

The vacuum source may be a high flow vacuum source (such as a blower) that may, for example, provide an air flow of at least about 100 cubic feet per minute, and a vacuum pressure of no more than about 100,000 Pascals below atmospheric, or no more than about 85,000 Pascals below atmospheric, or no more than about 65,000 Pascals below atmospheric. The use of such a high flow vacuum source may further disturb empty light shipping containers unless secured as disclosed herein.

Figure 2A:
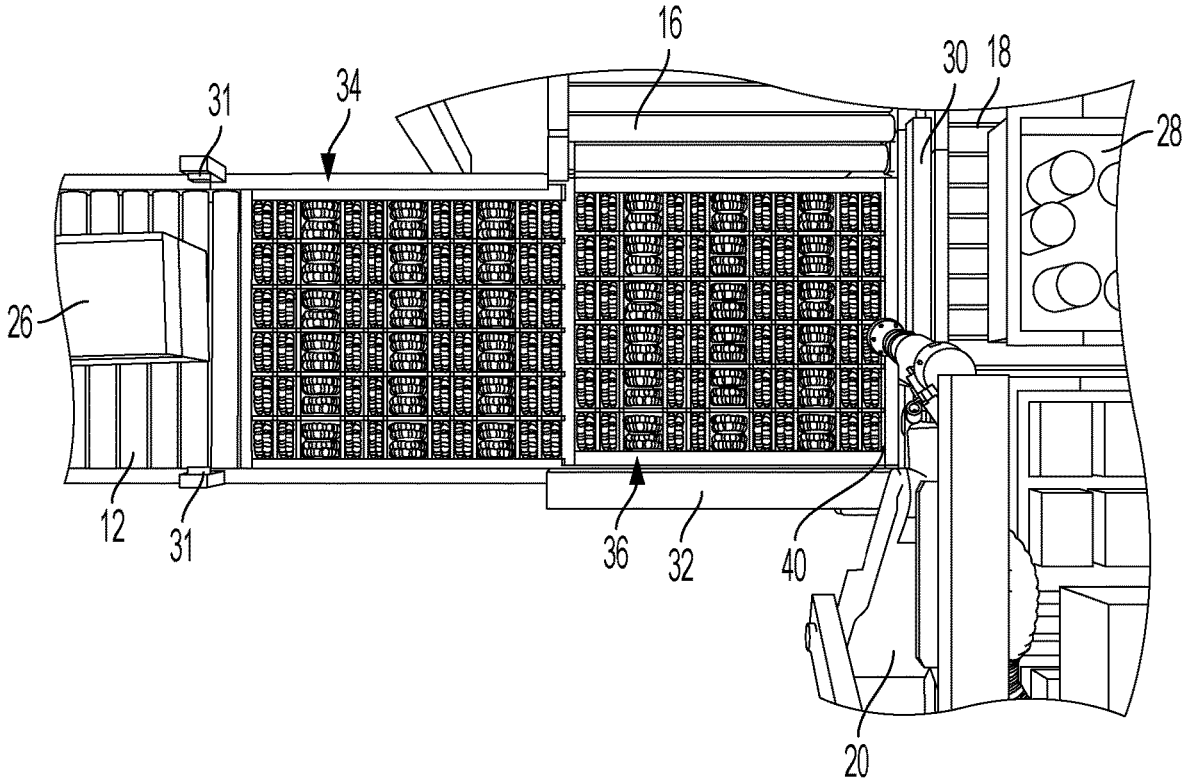
FIGS. 2A-2D show illustrative diagrammatic top views the place stack of FIG. 1, showing a container approaching the place stack (FIG. 2A), showing the container being positioned on the place stack (FIG. 2B), showing the container at a loading location on the place stack (FIG. 2C), and showing the container exiting the place stack (FIG. 2D)
Figure 2B:
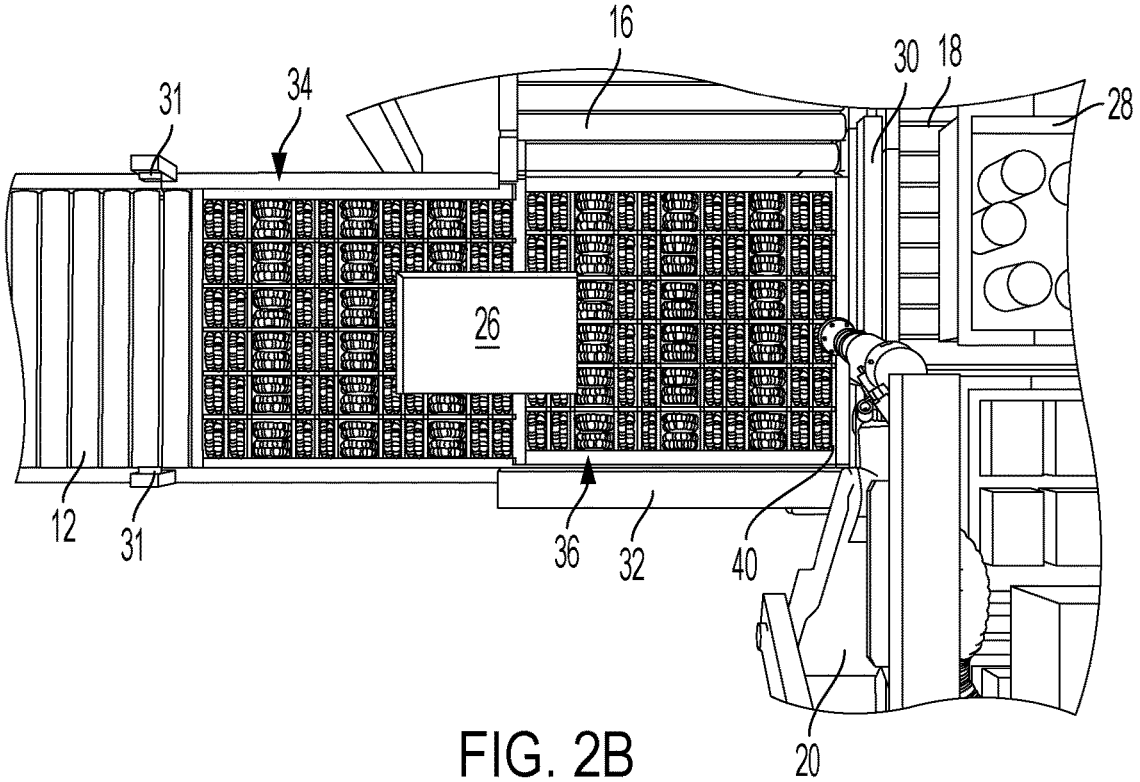

With reference to FIG. 2A, an empty shipping container (e.g., a cardboard box) 26 approaches the place stack in any of a variety of orientations on the input conveyance system 12. Perception units 31 may be used to verify the presence of a container and even the identify of each container as they travel along the input conveyance system 12. When the container 26 encounters the one or more multidirectional units 34, 36 the container 26 is urged toward a brace corner 40 closest to the programmable motion device 20 against braces 30, 32. FIG. 2B shows the container being moved toward the corner formed by the braces 30, 32. Perception units 38 (shown in FIG. 1) on the support structure for the programmable motion device may determine the orientation (e.g., portrait or landscape with respect to the robot 20) by which the container is urged against the brace corner 40. The multidirectional unit 36 may be mounted on a weighing system as discussed in more detail below with reference to FIGS. 8 and 9. The place stack will begin to receive the container when the system detects that the container is entering or when the system otherwise receives a signal to expect a container and engage the multidirectional units to drive the container toward the brace corner 40.

Figure 2C:
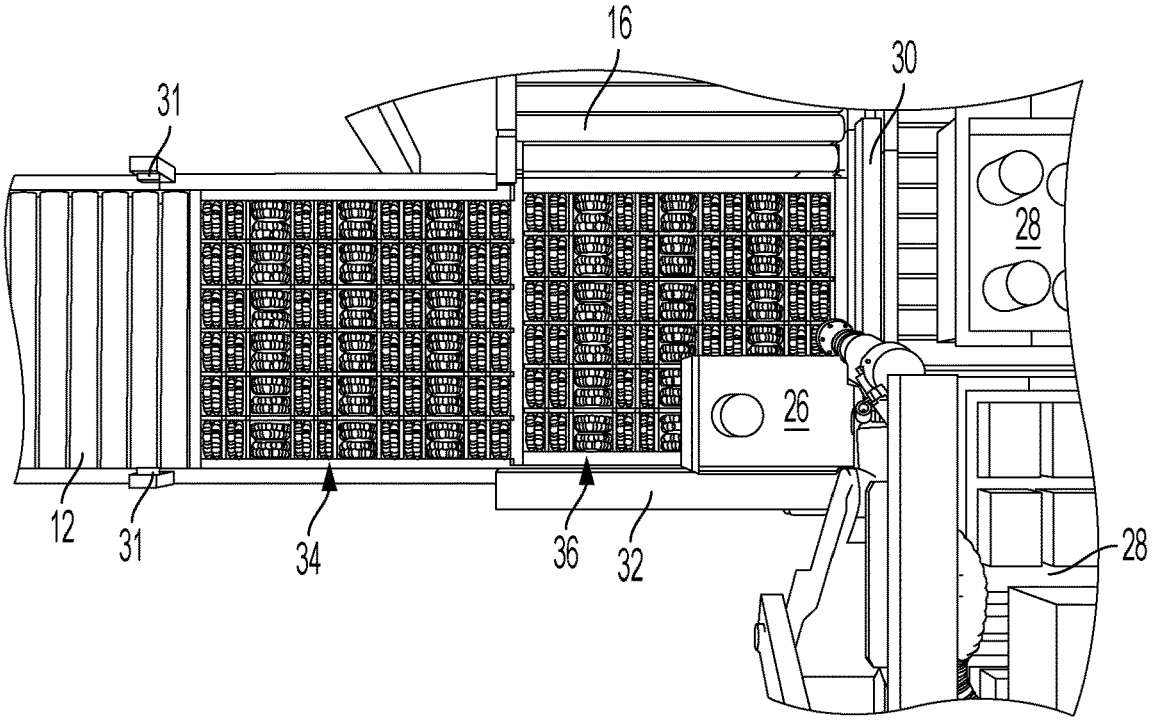
Figure 2D:
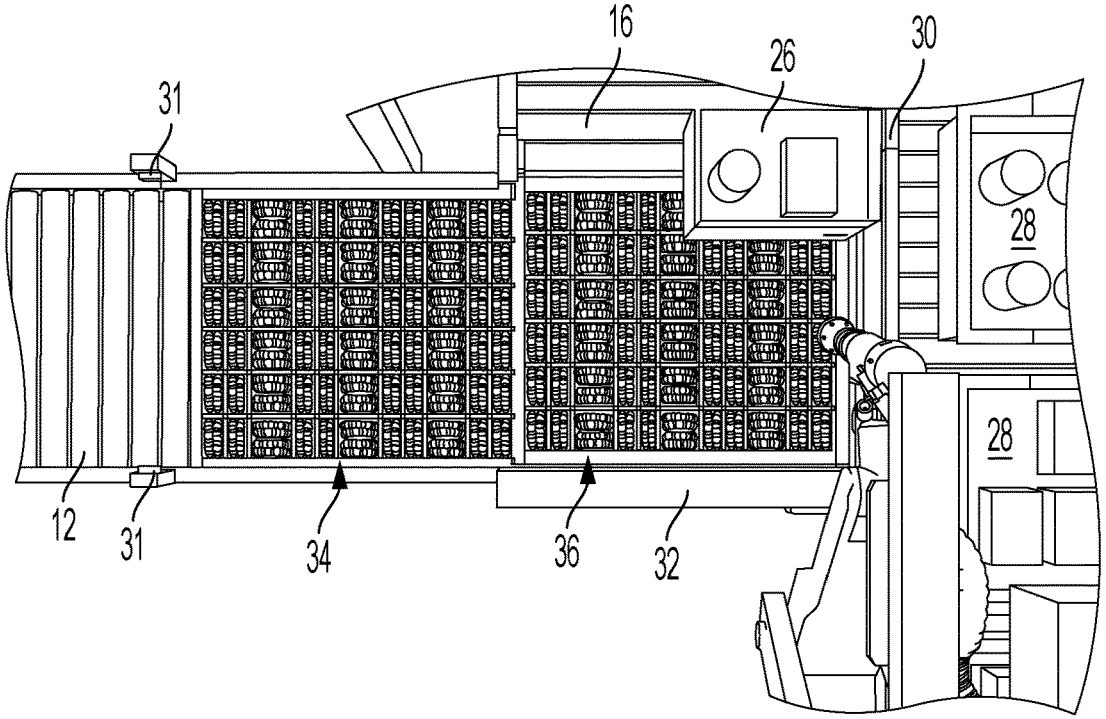

With reference to FIG. 2C, the robot 20 will begin to pack one or more objects into the container as required (as per a manifest), and the multidirectional unit 36 may either be reengaged between the packing of objects (in case of movement of the container) or the multidirectional unit 36 may remain engaged during the packing operations. In accordance with further aspects as discussed below further engagement mechanisms may be used to secure the container during packing. With reference to FIG. 2D, following completion of the packing operations, the container 26 is moved by the multidirectional unit 36 toward and onto the output conveyance system 16.

Figure 3:
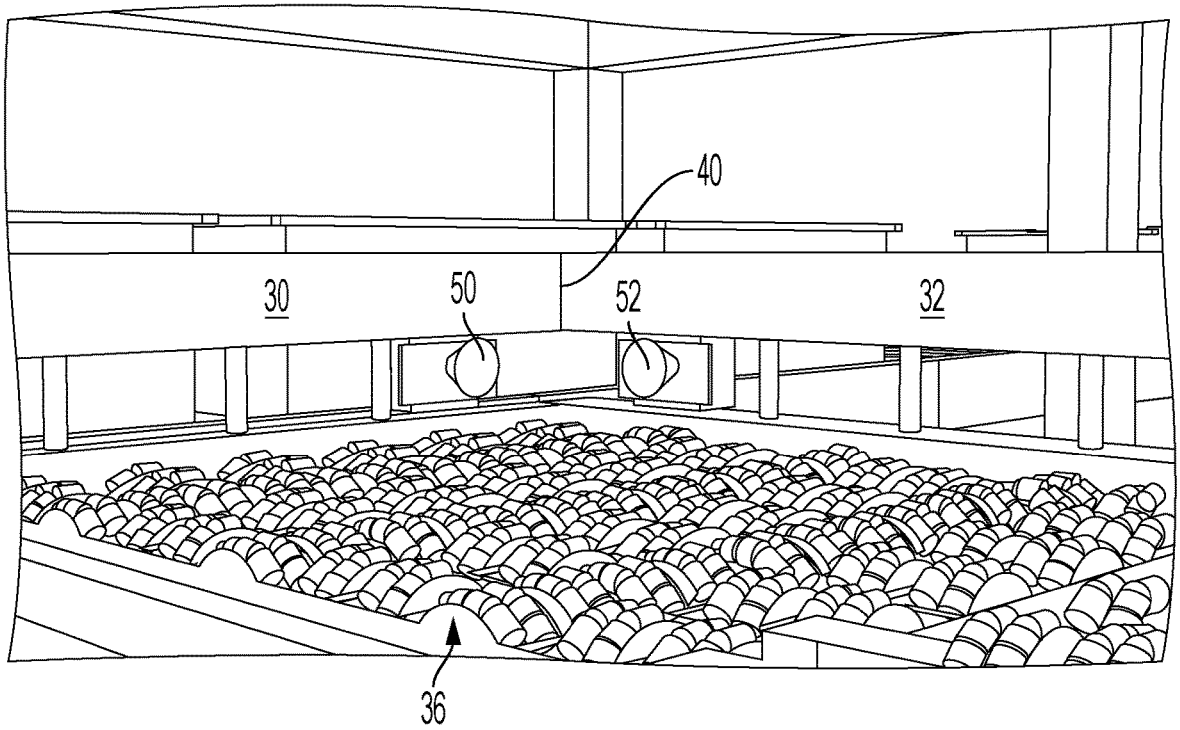
FIG. 3 shows an illustrative diagrammatic enlarged front view of the place stack of FIG. 1.

The multidirectional units 34, 36 may include multiple sets of omnidirectional wheels in mutually orthogonal directions as shown, and one multidirectional unit 36 only may be used rather than the two units as further shown in FIG. 3. Each multidirectional unit should be able to efficiently (without slipping) manipulate both very light containers (e.g., small cardboard boxes) and containers with smooth or patterned bottom surfaces. In accordance with further aspects, other systems may be used for the multidirectional unit(s) including any of omnidirectional units, right-angle transfer conveyors (elevatable belts nested between rollers), activated roller belt technologies with belt actuated rolling elements integrated into a looping belt, and high performance divert modules with container conveying drive wheels that change yaw angle orientation to move containers at vector angles of up to ninety degrees. The type of multidirectional unit used may address various issues of speed, container engagement, cost and complexity of cleaning in the event that objects or debris fall onto or into the unit.

Figure 4:
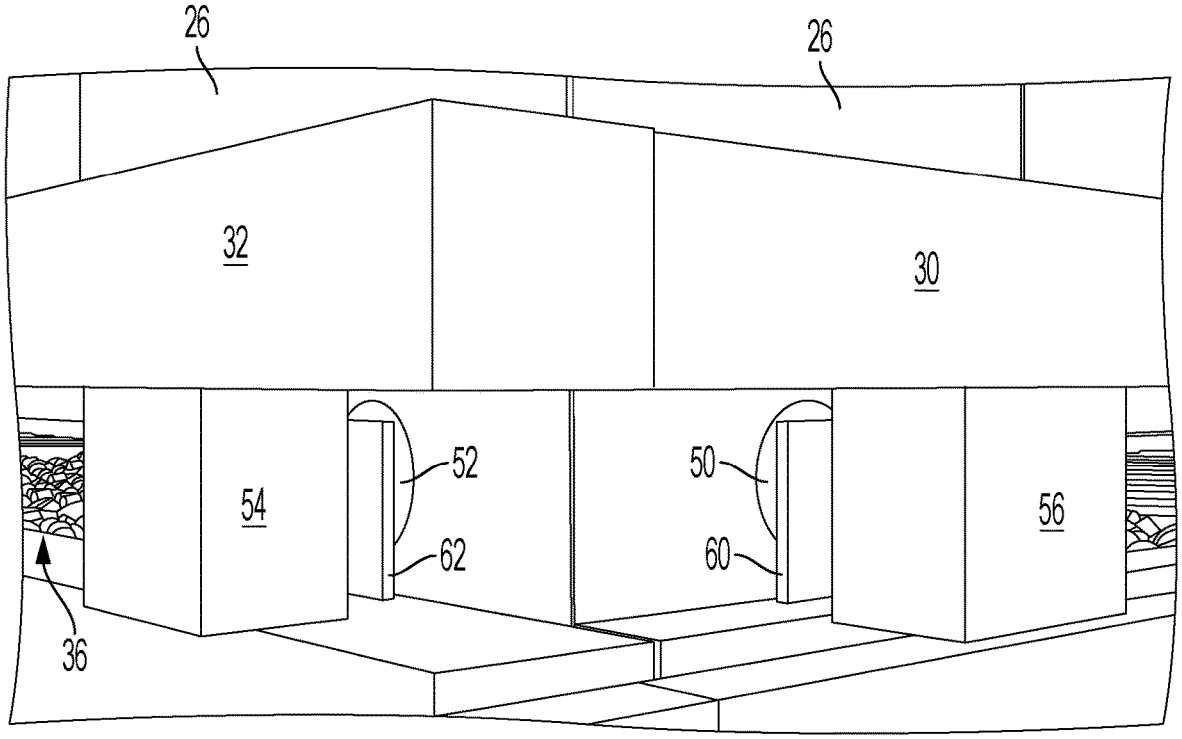
FIG. 4 shows an illustrative diagrammatic rear view of the place stack of FIG. 1.

An enlarged view of the multidirectional wheels in mutually orthogonal directions in the multidirectional unit 36 is shown in FIG. 3. As also shown in FIG. 3, the system may include a securement system that includes one or more vacuum cups 50, 52 (also coupled to vacuum source 24) positioned near the corner 40. FIG. 4 shows an opposite (rear) view of the vacuum 50, 52 with a container 26 urged in the corner 40 against the braces 30, 32. The one or more vacuum cups 50, 52 (one only may be used) may be engaged to hold a container against the corner 40 during packing, for example, to secure the container against movements imparted by the packing operations. Such movements may include the end-effector contacting the container or an object being held by the end-effector contacting the container, particularly during high throughput operation. Other movements may be imparted by rapid placement of objects in the container. The vacuum cups may be engaged throughout the packing operation, and may be positioned to contact a container only when a container is urged fully against the corner 40.

In accordance with other aspects, the vacuum cups may be extendable/retractable by actuators 60, 62 to move toward and contact a container when the systems detects that a container is urged against the corner 40 as shown in FIG. 4. Such extension/retraction may be helpful in situations, for example, when the empty container does not sit flat on the multidirectional unit (e.g., it rocks). The vacuum source 54, 56 may be provided at the vacuum cups 50, 52 or a common vacuum source may be remotely coupled to each vacuum source to provide the pneumatic fixturing in accordance with various aspects of the present invention.

Figure 5:
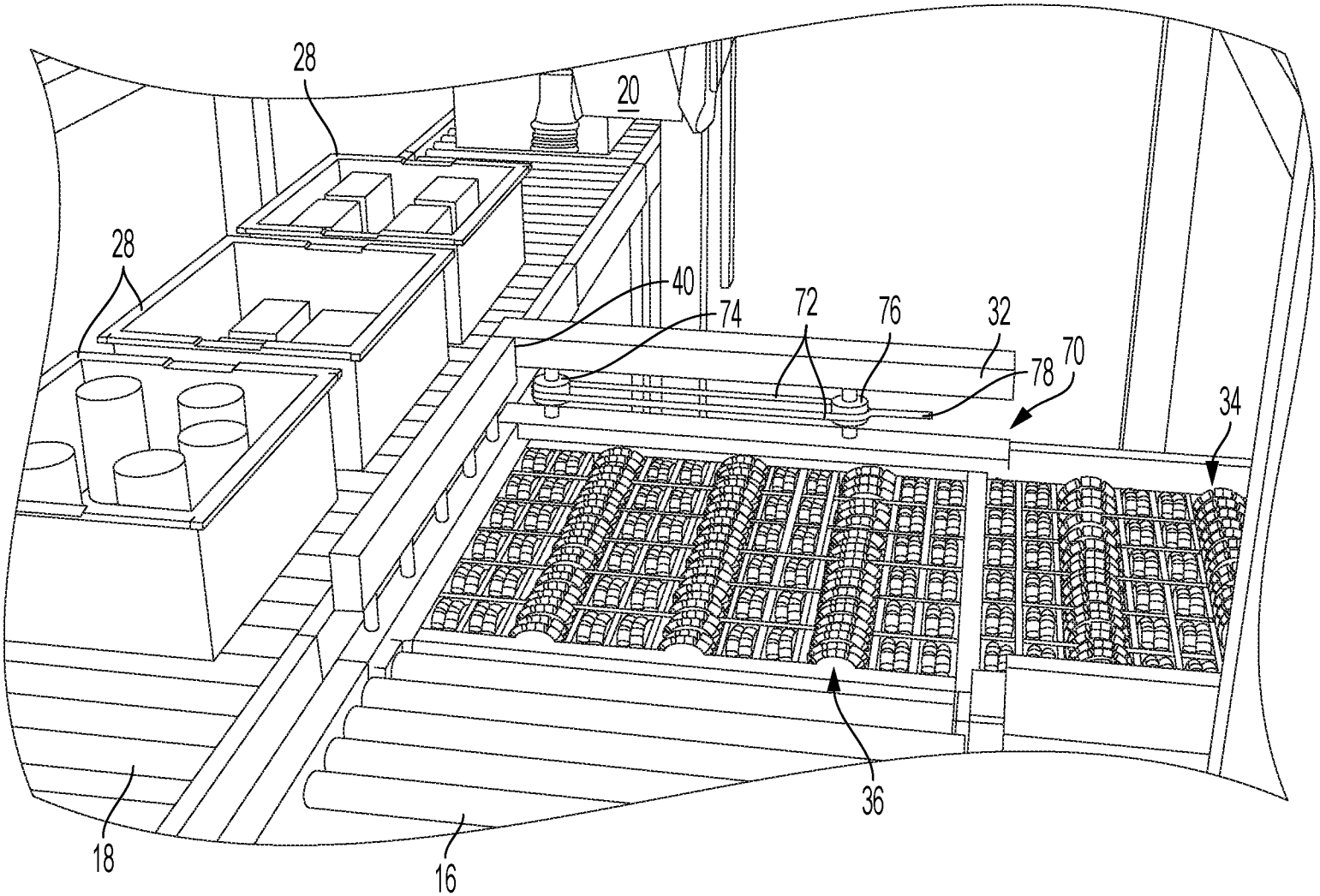
FIG. 5 shows an illustrative diagrammatic elevated view of a place stack of an object processing system in accordance with an aspect of the present invention that includes a securement system that includes a belt-mounted finger system.
Figure 6:
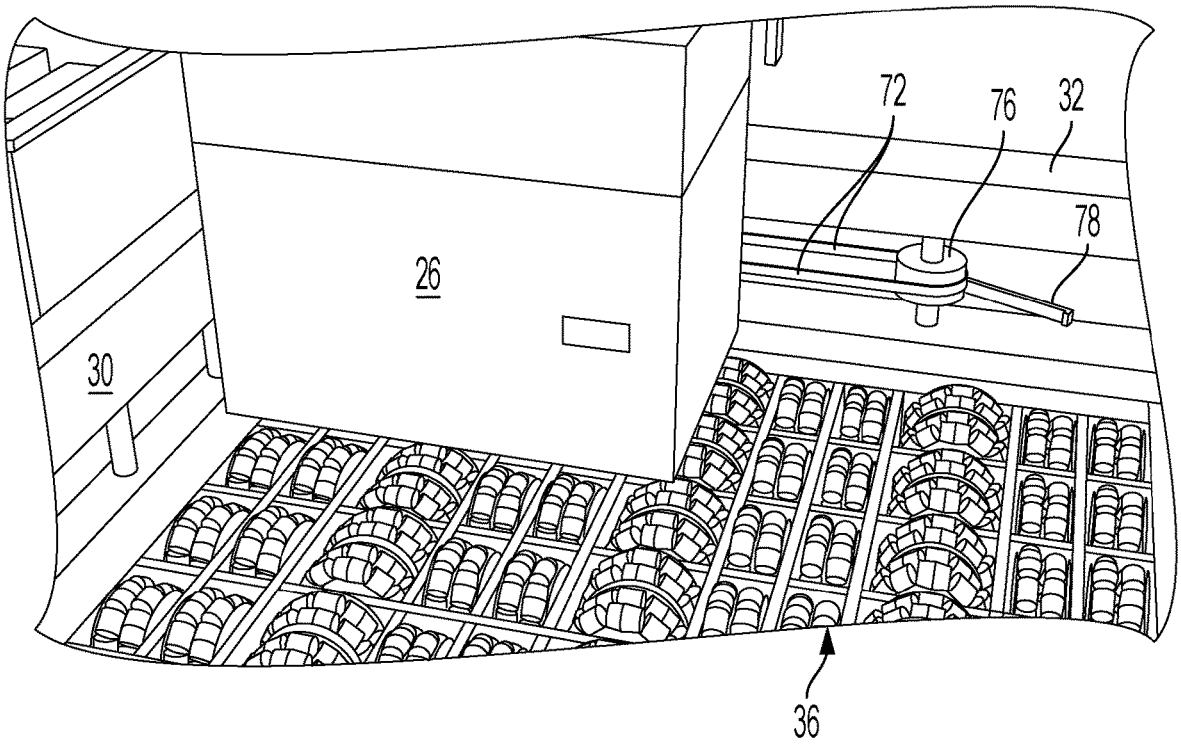
FIG. 6 shows an illustrative diagrammatic elevated view of the securement system of FIG. 5 with the belt-mounted finger beginning to move.
Figure 7:
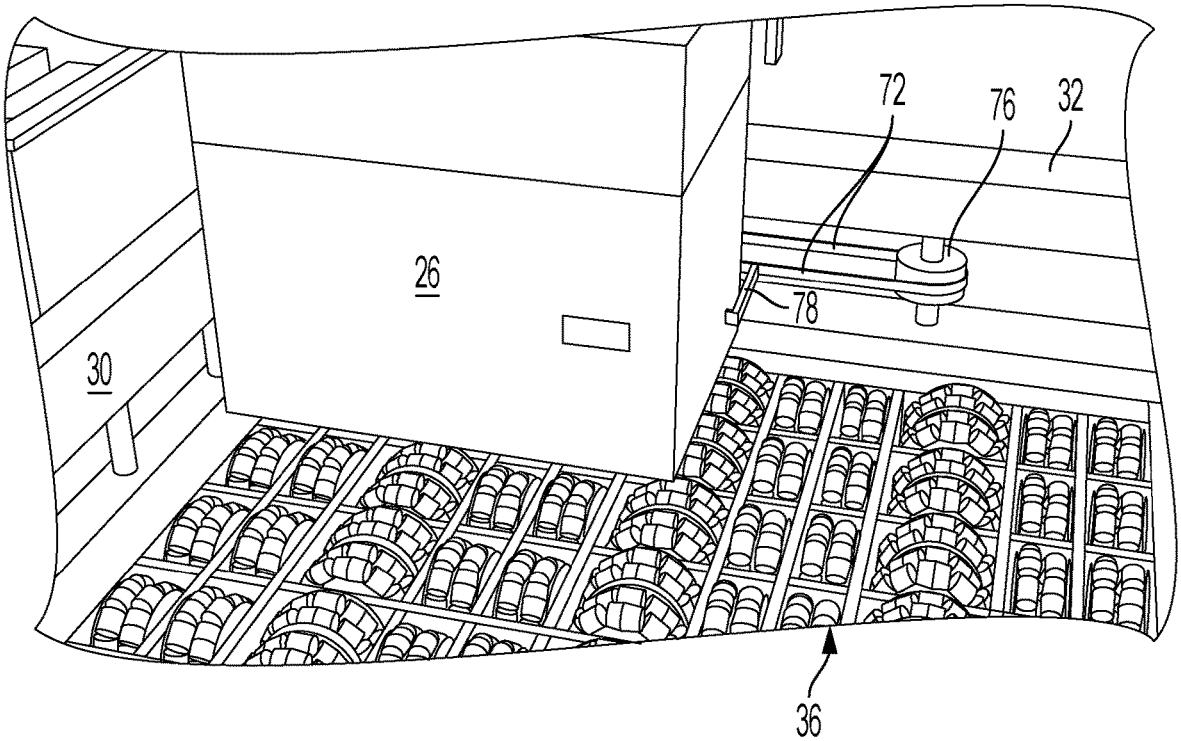
FIG. 7 shows an illustrative diagrammatic elevated view of the securement system of FIG. 5 with the belt-mounted finger securing the container in a loading position.

In accordance with further aspects, systems of the invention may further employ a securement system 70 as shown in FIG. 5. The belt-mounted finger system includes a belt 72 that operates around drive and follower rollers 74, 76 and includes a mounted (e.g., welded or screw fastened) finger 78. When a container 26 is urged against the corner 40 provided by braces 30, 32 the belt 72 is driven to move the finger 78 from its home position (shown in FIG. 5) against the container 26. FIG. 6 shows the finger 78 leaving the home position and FIG. 7 shows the finger 78 engaging the container 26. Following the packing operations, the belt 72 is run in the reverse direction to return the finger 78 to its home position shown in FIG. 5.

Figure 8:
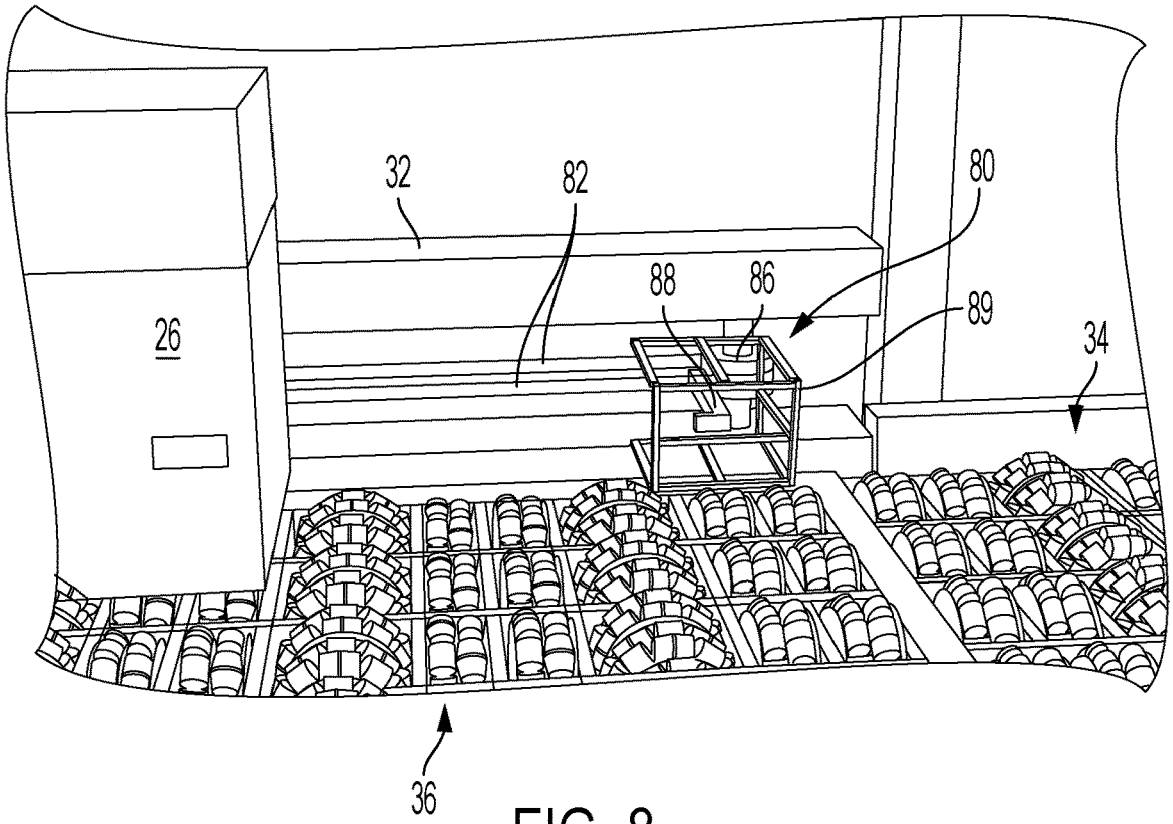
FIG. 8 shows an illustrative diagrammatic elevated view of a place stack of an object processing system in accordance with an aspect of the present invention that includes a securement system that includes a belt-mounted finger system within a protective cage.
Figure 9:
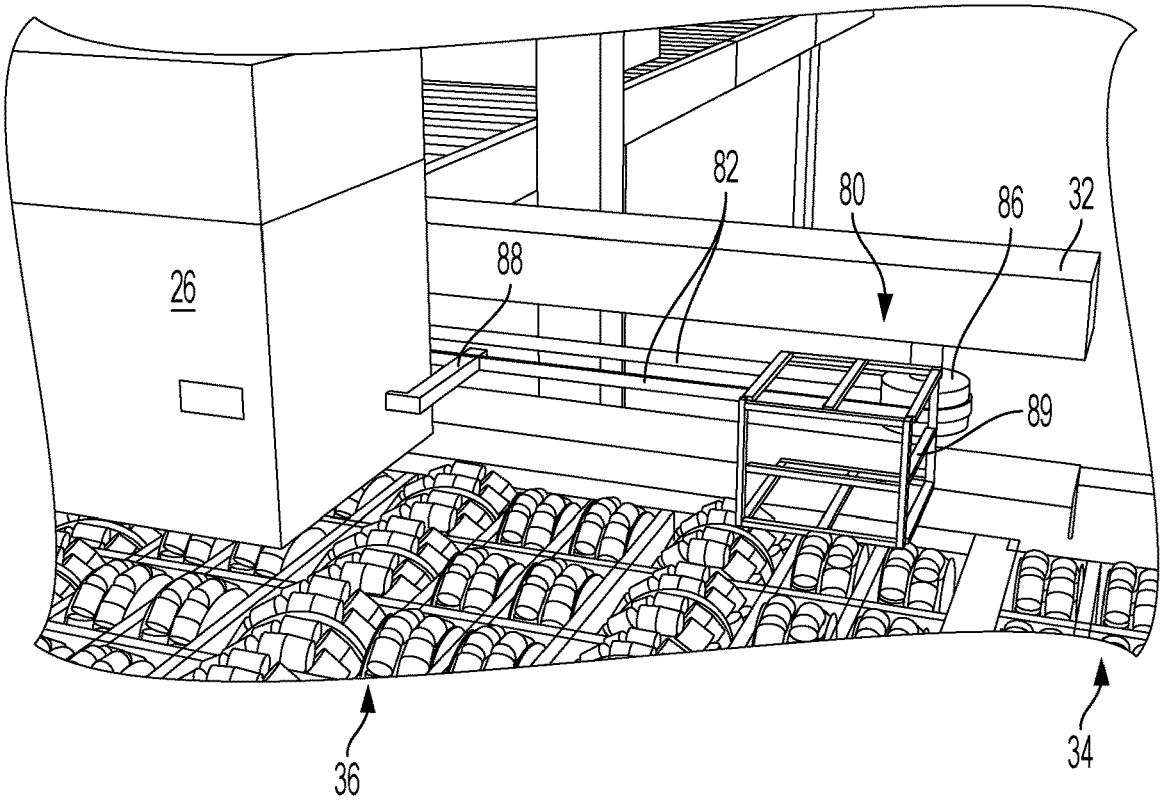
FIG. 9 shows an illustrative diagrammatic elevated view of the belt-mounted finger of FIG. 8 securing the container is a loading position.

In certain applications where it is desirable to not have the finger move around a roller (due to stress on the joint between the finger and the roller), the finger may be stored in a protected area (when not used) and the containers 26 must be directed to avoid contacting the protected area. In such applications, the finger may be fabricated from a stiffer material and may engage both sides of the belt (in applications where it will not have to move over a roller). For example, FIG. 8 shows a securement system 80 that includes a more rigid finger 88 secured to both sides of a belt 82. When in the home position as shown in FIG. 8, the finger 88 is enclosed within a garage 89, and when in the engaged position, the finger 88 has moved out of the garage 89 and contacts the container 26 as shown in FIG. 9. The system of FIGS. 8 and 9 does require that containers be moved across the multidirectional unit 36 such that the container being positioned does not contact the garage 89. In either application, the finger may begin to move prior to the container fully contacting the corner 40.

Figure 10:
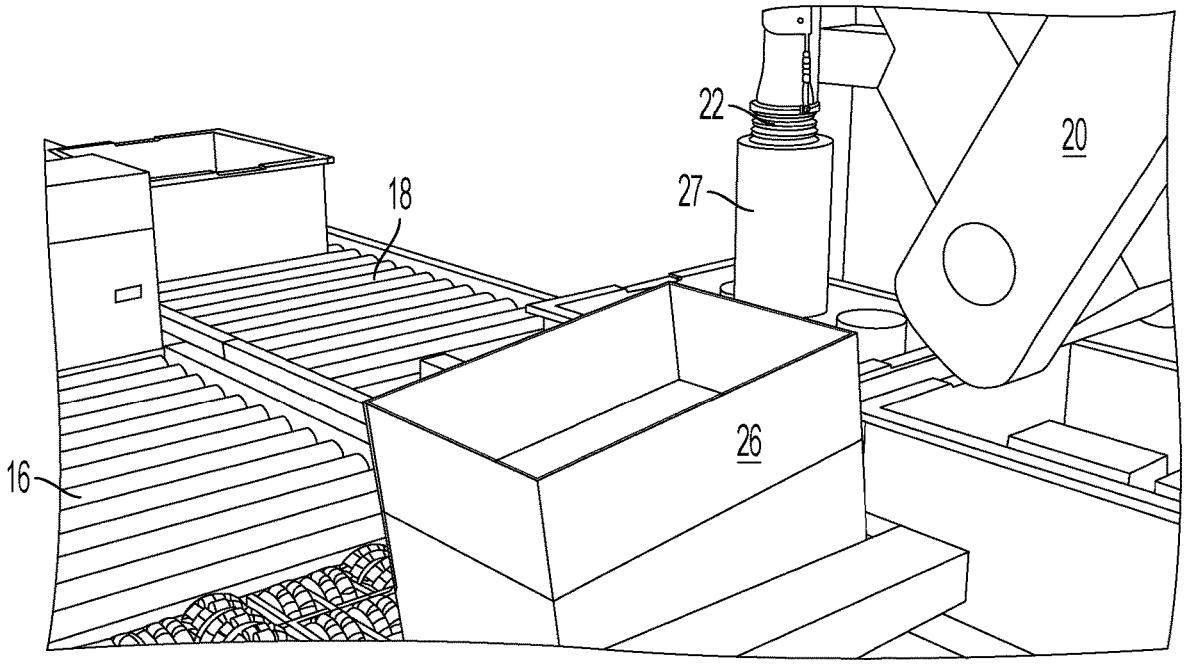
FIG. 10 shows an illustrative diagrammatic view of an object being moved by an end-effector toward a container.
Figure 11:
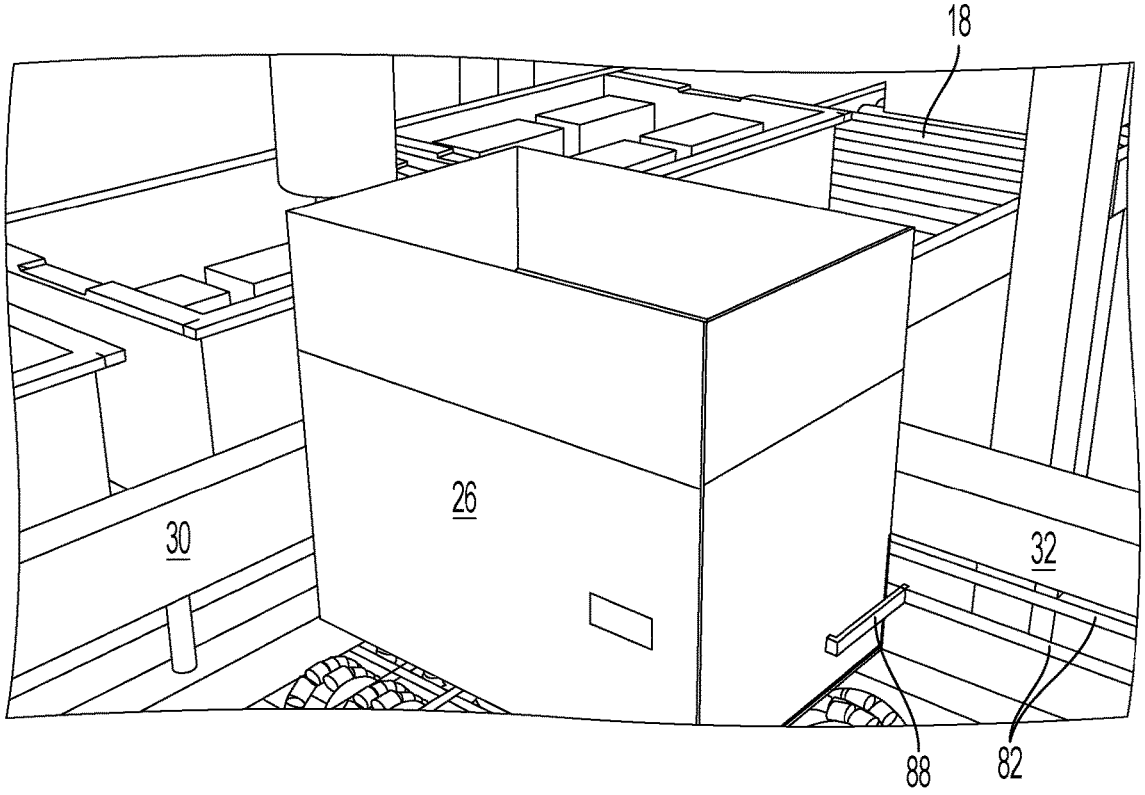
FIG. 11 shows an illustrative diagrammatic view of an object being moved while the container is secured by a securement system in accordance with an aspect of the invention.

The securement system (e.g., any of the pneumatic system with one or more vacuum cups 50, 52 as discussed above with reference to FIGS. 3 and 4, or the securement systems 70 and 80 that include a belt-mounted finger as discussed above with reference to FIGS. 5-9), may assist in stabilizing the container while the container is being quickly packed. For example, FIG. 10 shows an object 27 being held by the end-effector 22 while being moved toward the container 26 without a securement system. If for any reason the object 27 contacts the container (which again may be very light when empty), the container may move as shown in FIG. 10, which may slow down the packing and/or result in a need for intervention by human personnel causing further delays. When a securement system (e.g., again of any of FIGS. 3-9) is used the container 26 (together with the securement system) will resist the movement that may otherwise occur by, in part, having the container 26 withstand and absorb the small amount of deflection of the top of the container 26 that would otherwise have been caused by the object 27 contacting the container 26 as shown in FIG. 11. The use of the securement systems may therefore facilitate providing a higher throughput of packing the light containers. Further, the securement system of FIGS. 3 and 4 that use the vacuum cups may be used together with any of the securement system 70 of FIGS. 5-7 or the securement system 80 of FIGS. 8 and 9.

Figure 12:
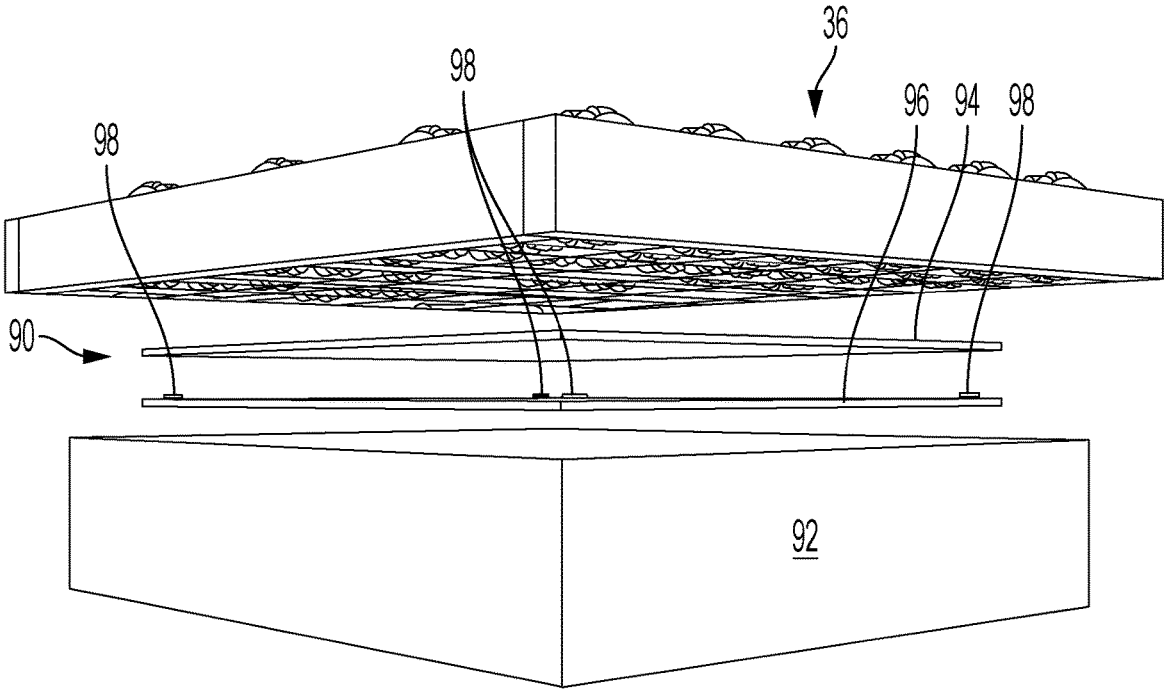
FIG. 12 shows an illustrative diagrammatic side exploded view of a weight detection system for use in place stack detection and object processing systems in accordance with further aspects of the present invention.
Figure 13:
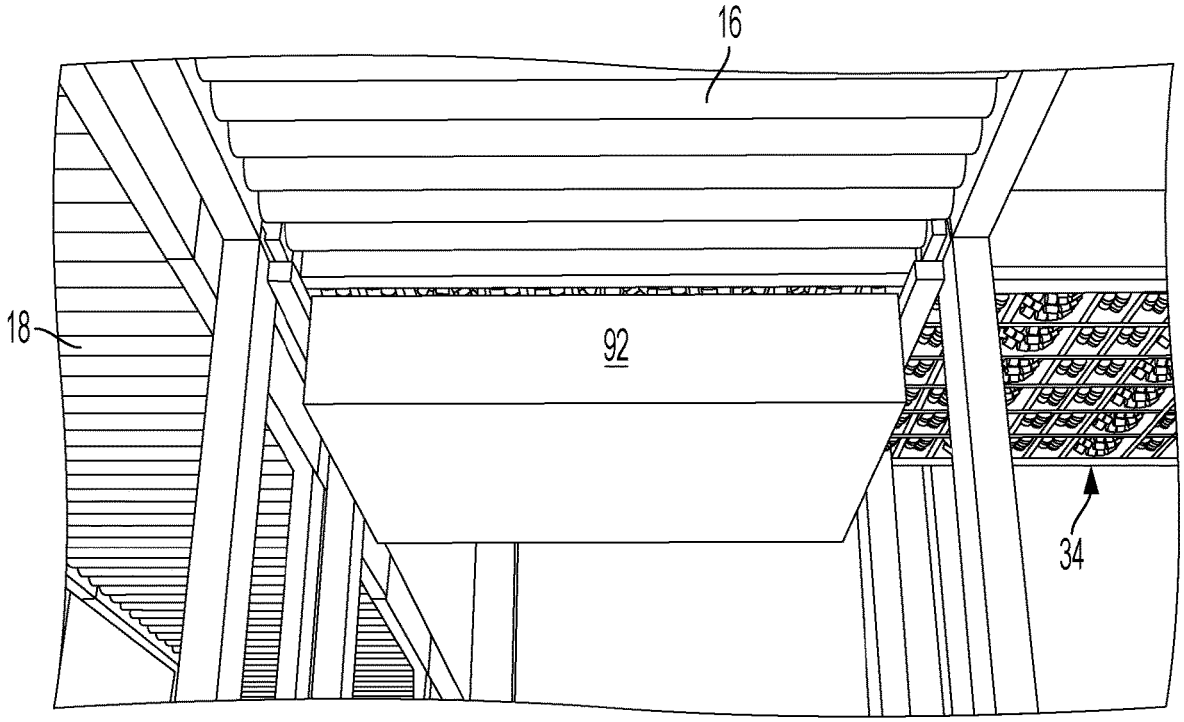
FIG. 13 shows an illustrative diagrammatic underside view of the weight detection system of FIG. 12.

In accordance with further aspects (and together with any of the vacuum cup or finger engagement systems discussed above), the multidirectional unit 36 may be mounted on a weight sensing system 90 that includes plates 94, 96 with load cells or force torque sensors 98 therebetween, all mounted on a base 92 as shown in FIG. 12. Using the weight sensing system 90 permits the system to know when a container is on the unit 36 and to verify each placement operation in the packing process. FIG. 13 shows an underside view of the place stack area showing the base 92 of the weight sensing system from the underside.

Figure 14A:
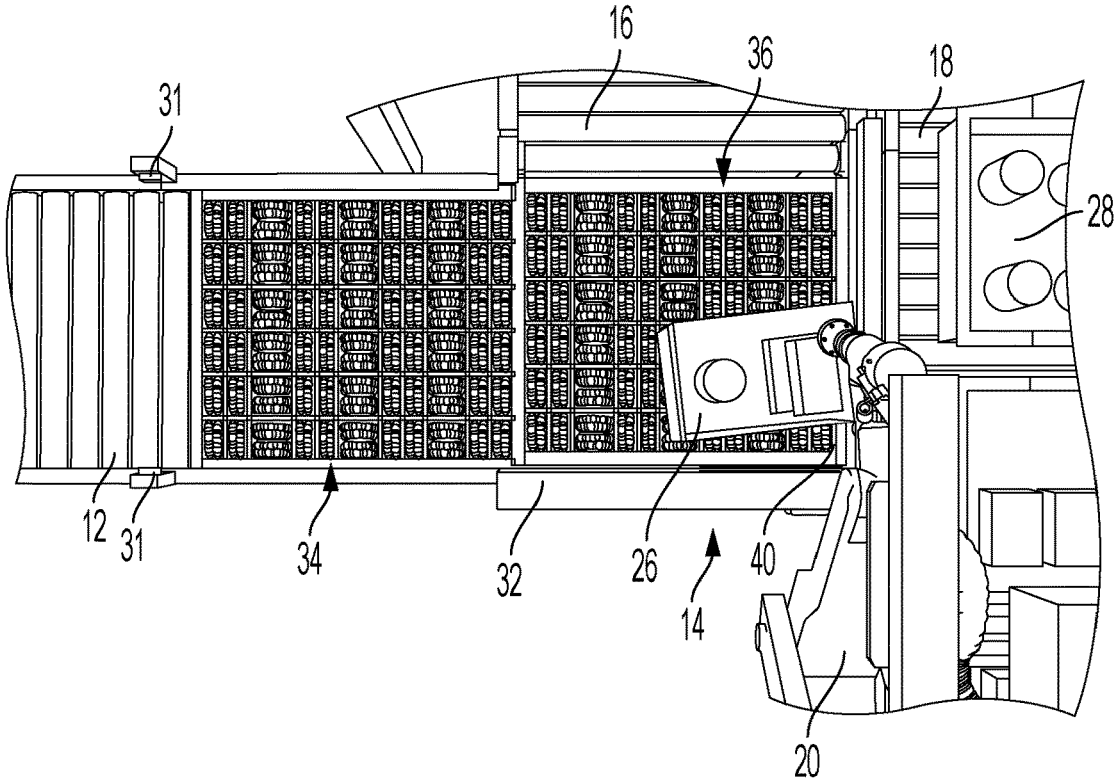
FIGS. 14A and 14B show illustrative diagrammatic top views of the place stack of FIG. 1 showing a container becoming dislodged (FIG. 14A) and showing the container again properly positioned (FIG. 14B)
Figure 14B:
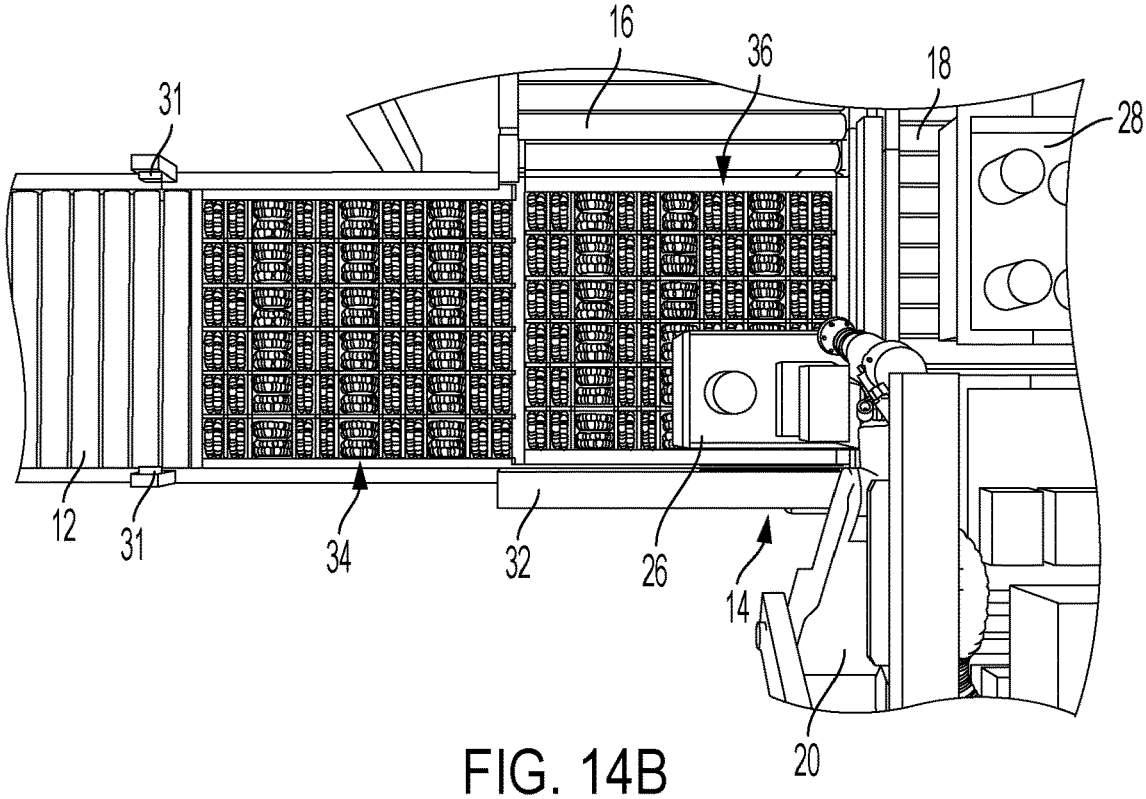

In applications in which a container (e.g., 26) does become dislodged from the corner 40 (either by overcoming a securement system or when no securement system is used), the container may move on the multidirectional unit 36 (accidently) without engaging the multidirectional unit as shown in FIG. 14A. This may occur, for example, when an object is being placed into the container if the object contacts the outside of the container (as shown in FIG. 10), or if the container moves when the object is placed into the container, either by the movement of the object and/or the end-effector of the programmable motion device 20. In this situation and with reference to FIG. 14B, the multidirectional unit 36 may be engaged to re-direct the container into the corner 40 (shown in FIG. 14B). The one or more perception systems 38, are used to determine whether the container 26 has become dislodged, whereupon the multidirectional unit 36 is engaged to re-direct the container into the corner 40 responsive to the perception data. In accordance with other aspects, the weight sensing system 90 may be used to determine a location of the container on the multidirectional unit 36, and from this information determine that the container 36 needs to be re-directed into the corner 40 responsive to this information. In accordance with further aspects, the system may simply determine (via sensor(s)) whether or not the container is positioned against the corner 40 and engage the multidirectional unit 36 to move the container 26 toward the corner 40 responsive to this determination.

Figure 15A:
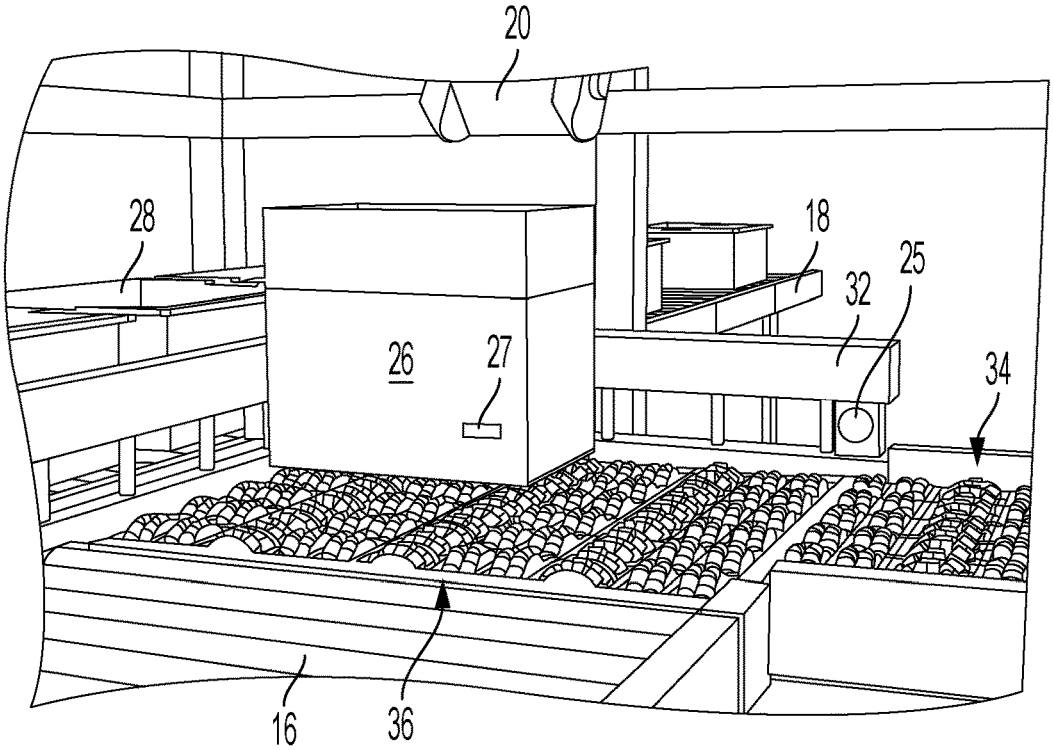
FIGS. 15A-15D show illustrative diagrammatic side views of the place stack of a system in accordance with a further aspect of the invention showing a container secured against the corner brace (FIG. 15A), showing the container having been released by the securement system and having been moved and turned on the multidirectional unit (FIG. 15B), showing the container having been moved onto a multidirectional unit upstream of a scanner (FIG. 15C), and showing the container being scanned by the scanner (FIG. 15D)
Figure 15B:
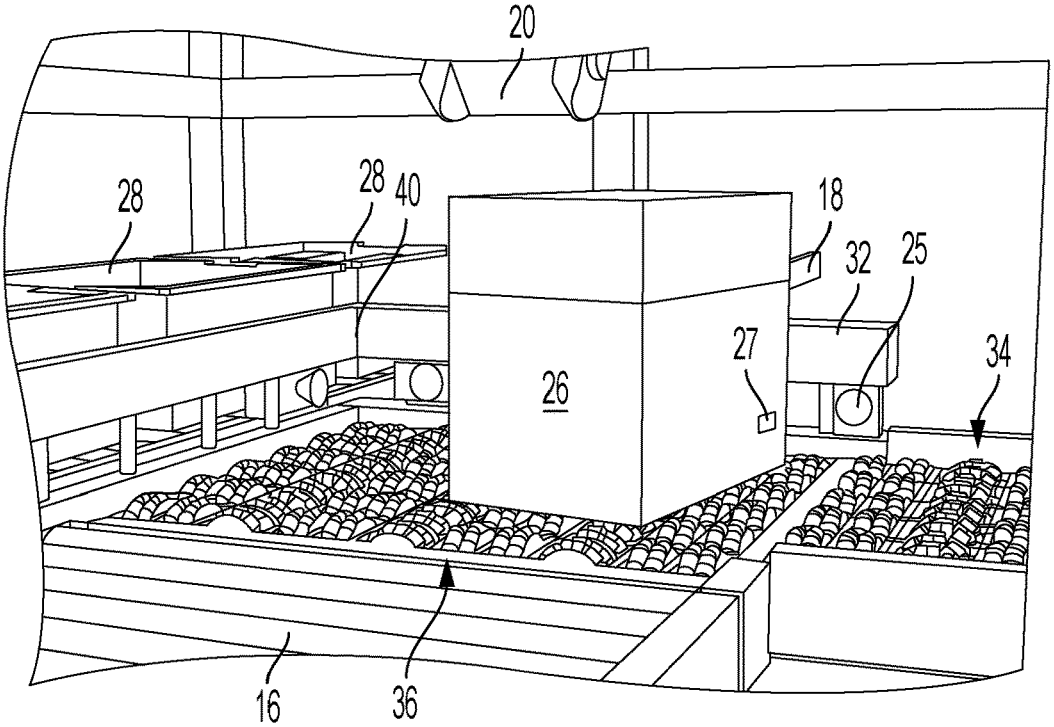
Figure 15C:
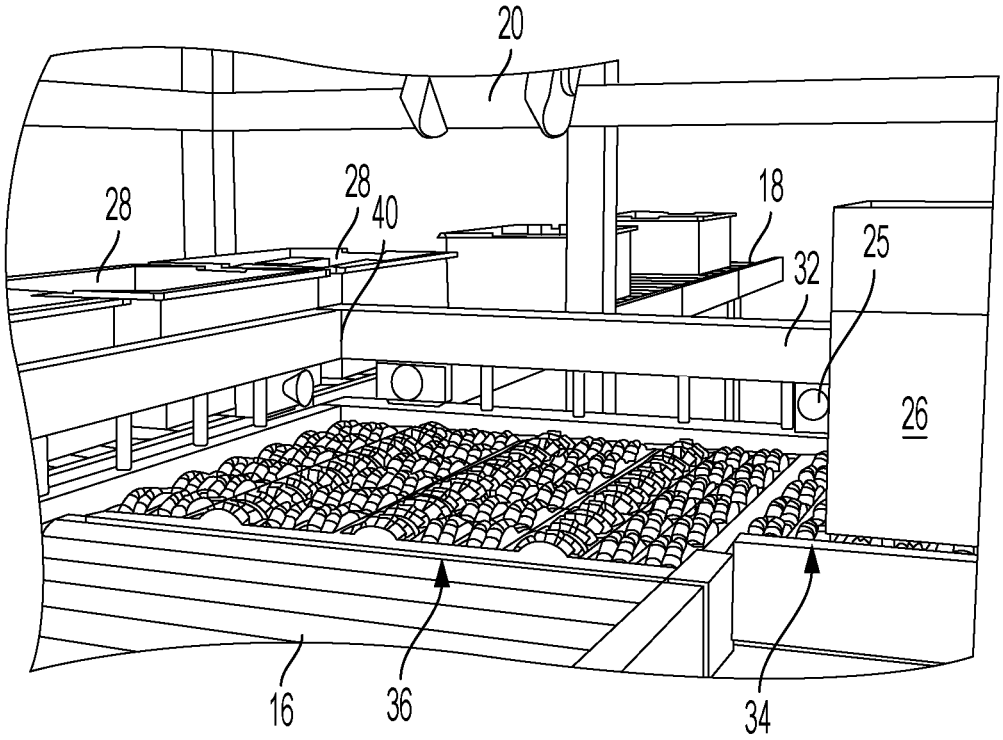
Figure 15D:
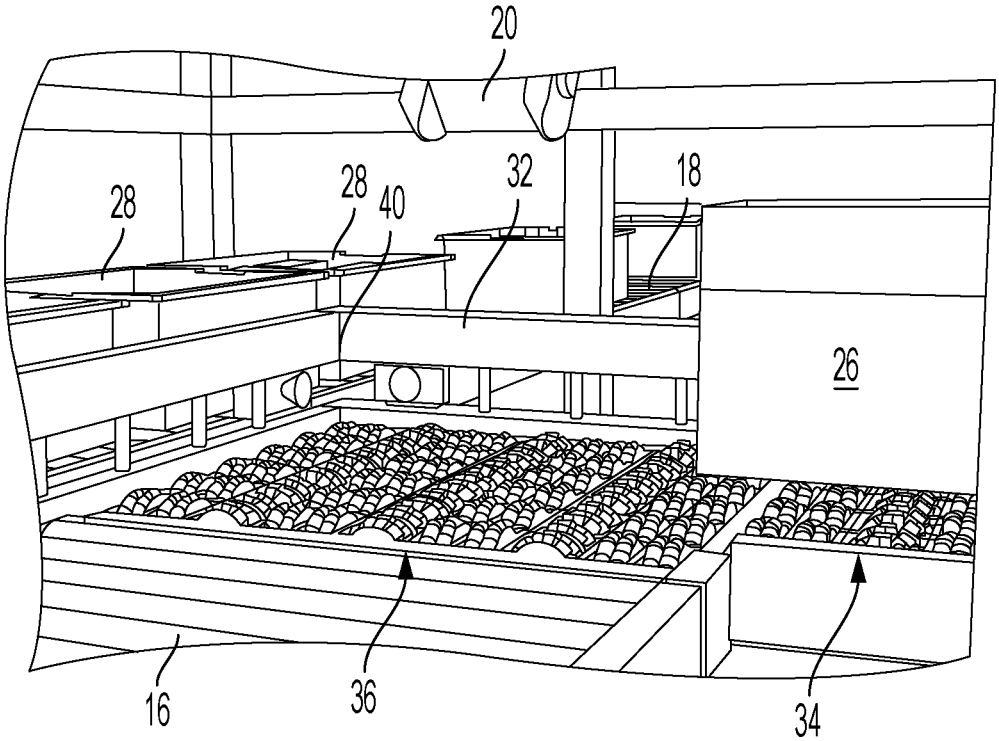

The multidirectional unit(s) 34, 36 may further be used to rotate any of the containers thereon. For example, in the system of FIG. 15A, container 26 is lodged against the brace corner 40 (shown in FIG. 15B), but a label 27 on the container 26 may have avoided being scanned by a confirmation scanner 25 (for example if only one label is placed on the container 26). The system may (disengage any securement system) and engage the multidirectional unit 36 to move the container more toward the center of the unit 36 and begin to rotate the container 26 as shown in FIG. 15B. The system may continue to rotate the container 26 and may even move the container backward onto the multidirectional unit 34 as shown in FIG. 15C. The system may then move the container 26 again toward the brace corner 40 (as shown in FIG. 15D) such that the label 27 may be scanned by the scanner 25. The ability to rotate containers provides substantial freedom in the packing operations.

Figure 16A:
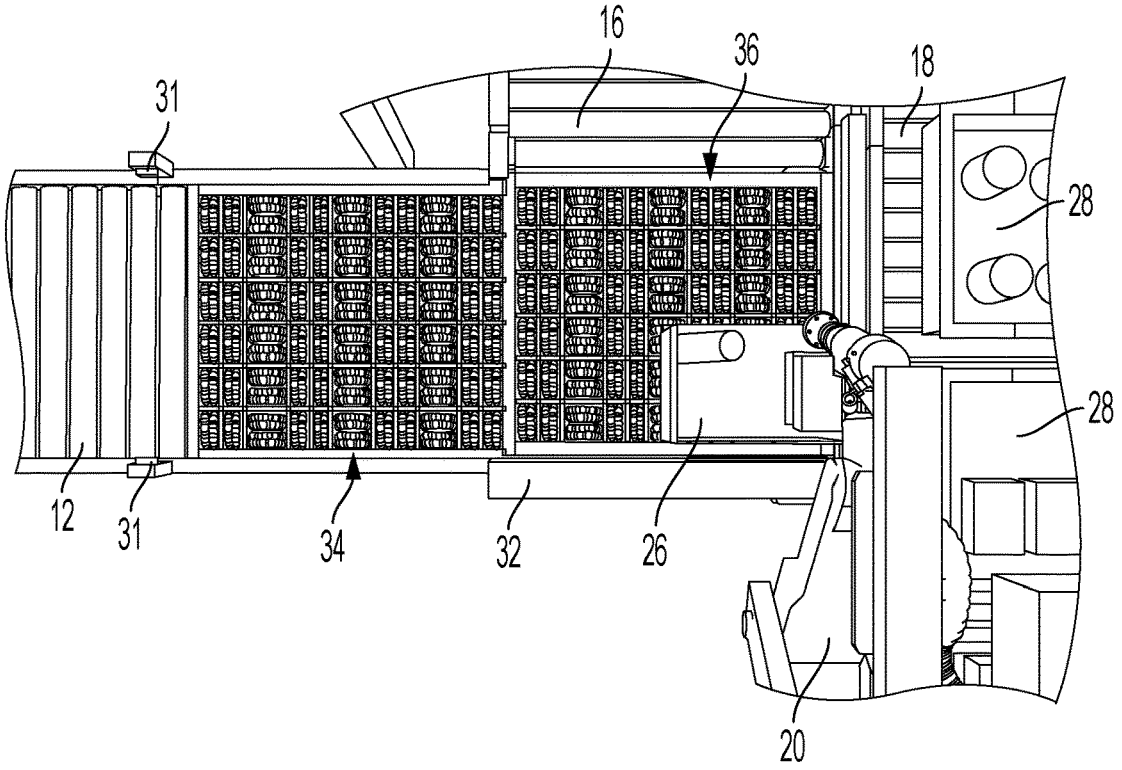
FIGS. 16A-16D show illustrative diagrammatic top views of the place stack of the system of FIG. 1 showing a tall object falling within a container (FIG. 16A), showing the tall object lying next to an inner wall of the container (FIG. 16B), showing the container having been moved away from the corner brace (FIG. 16C), and showing the container having been moved back into the corner brace (FIG. 16D)
Figure 16B:
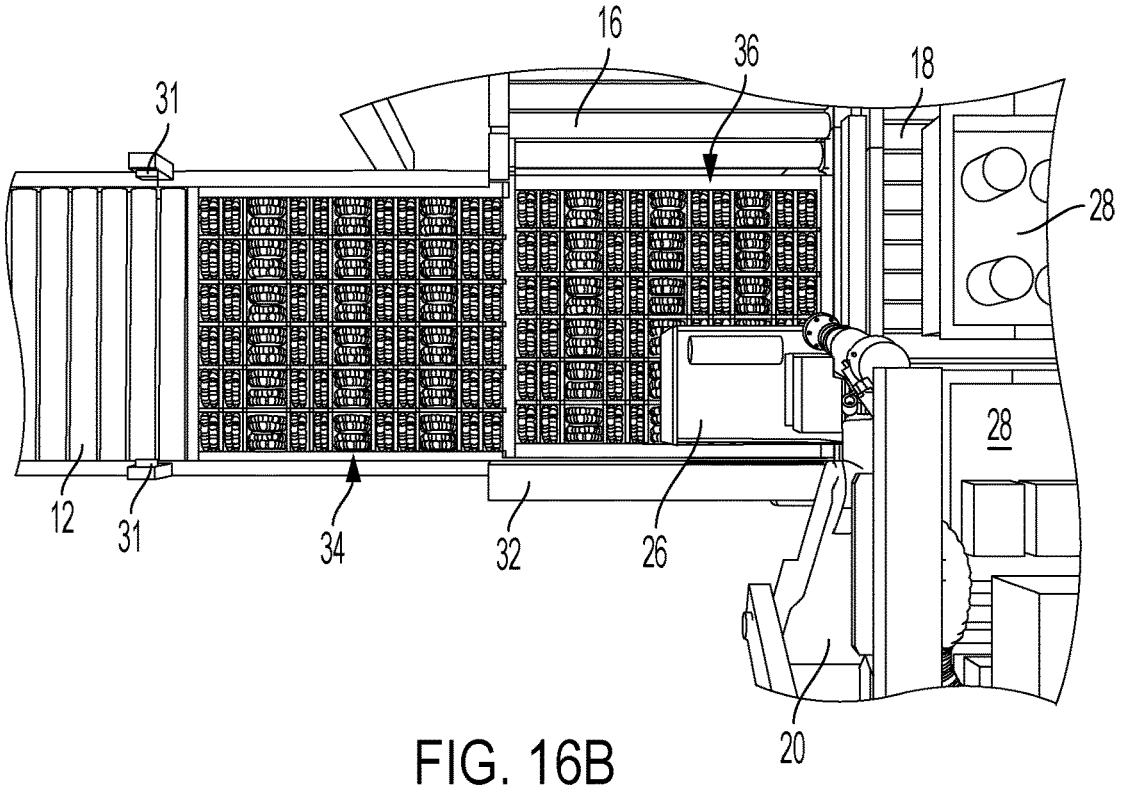
Figure 16C:
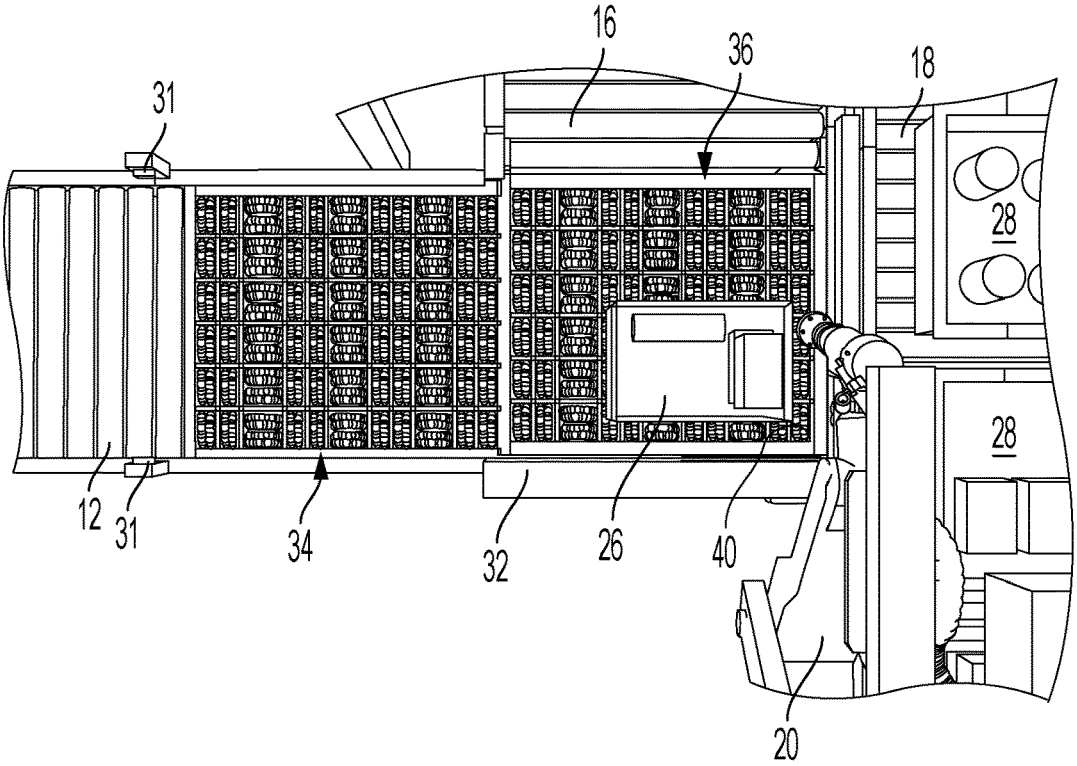
Figure 16D:
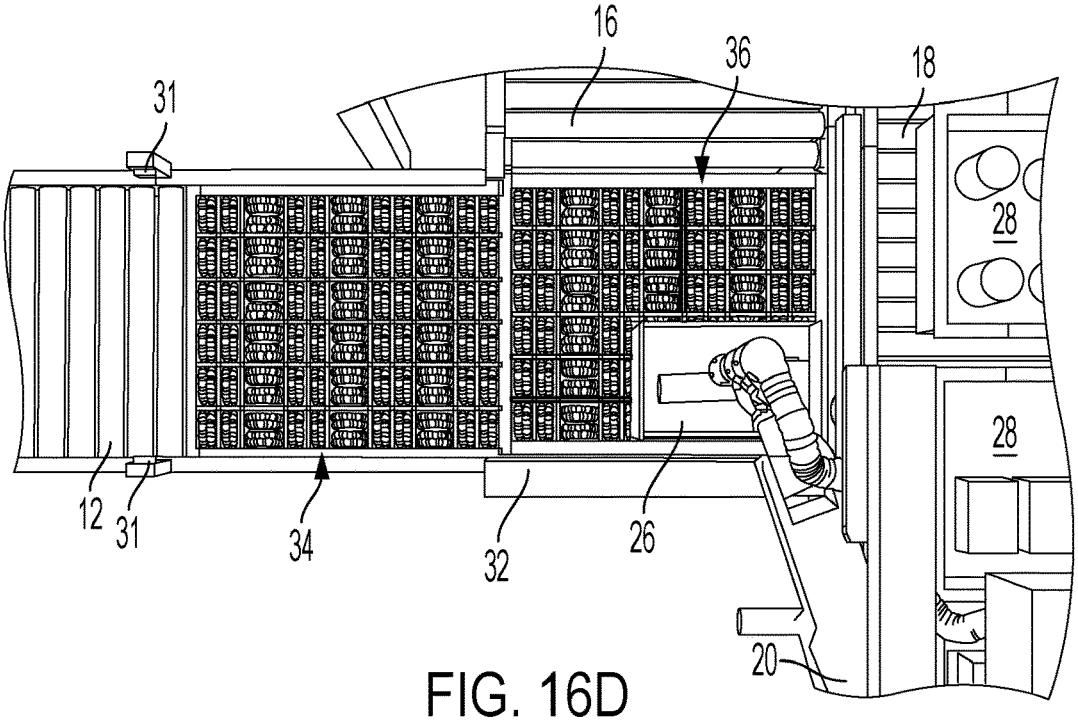

During packing of containers by the programmable motion device 20, it sometimes happens that an object is placed into the container at a desired location and orientation but then moves (or for any reason is not placed in a desired packing location and orientation). In this case, the programmable motion device 20 may seek to regrasp the object to again try to place the object in a desired location and orientation. FIG. 16A for example, shows a cylindrical object having been placed into container 26, but the object falls over in the container as further shown in FIG. 16B. The situation may be compounded by having the fallen object lie too close to an inner wall of the container for the programmable motion device 20 to regrasp the object. With reference to FIG. 16C, the system may engage the multidirectional unit 36 to move the container 26 away from the brace corner 40 (as shown in FIG. 16C) and then back against the brace corner 40 causing the one or more objects therein to move within the container 26 (as shown in FIG. 16D). The fallen object may then be regrasped (albeit from a different portion thereof) for repositioning within the container 26; the repositioning may further involve an additional step of placing the object at an intermediate location and further regrasping the object.

Figure 17A:
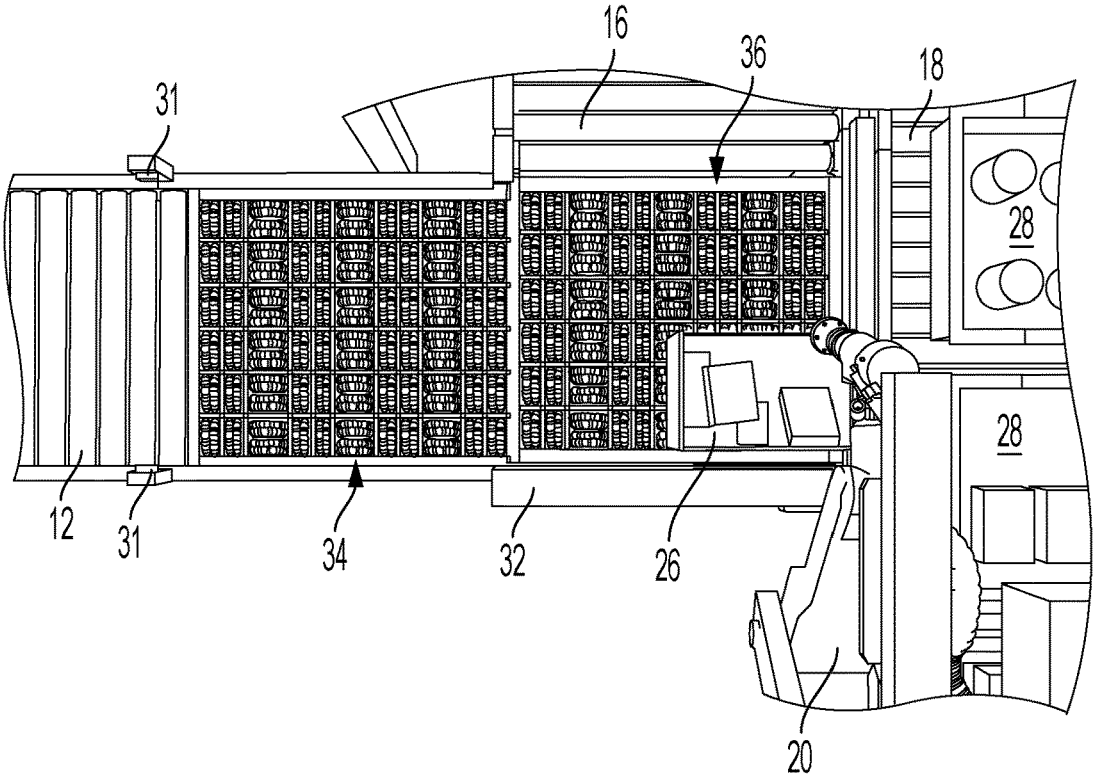
FIGS. 17A-17D show illustrative diagrammatic top views of the place stack of FIG. 1 showing plural objects within the container (FIG. 17A), showing the container having been moved toward a center of the multidirectional unit (FIG. 17B), showing the container having been rotated by the multidirectional unit (FIG. 17C), and showing the container having been returned to the corner brace with the plural objects within the container having settled (FIG. 17D)
Figure 17B:
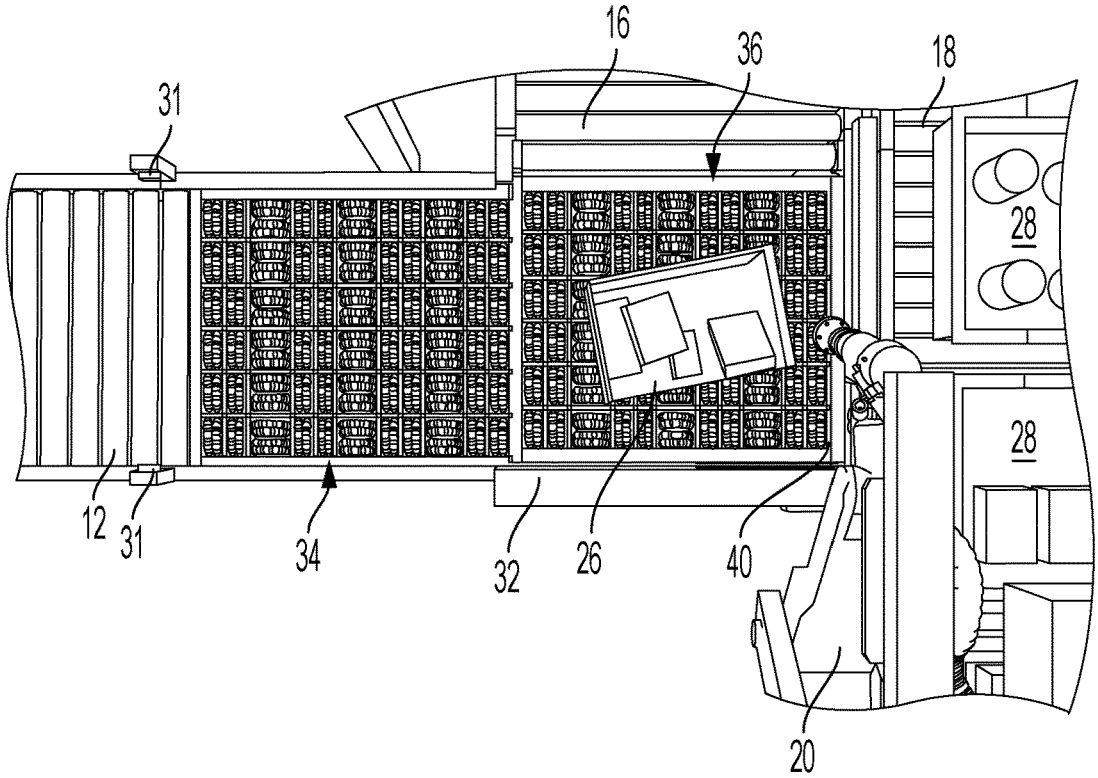
Figure 17C:
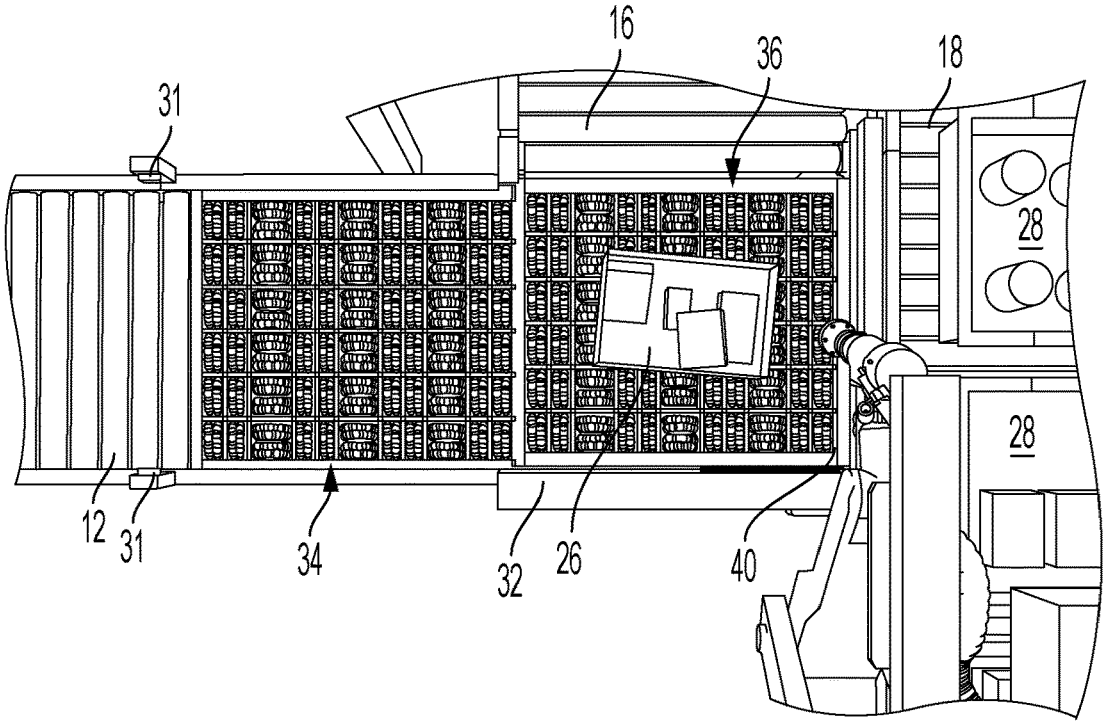
Figure 17D:
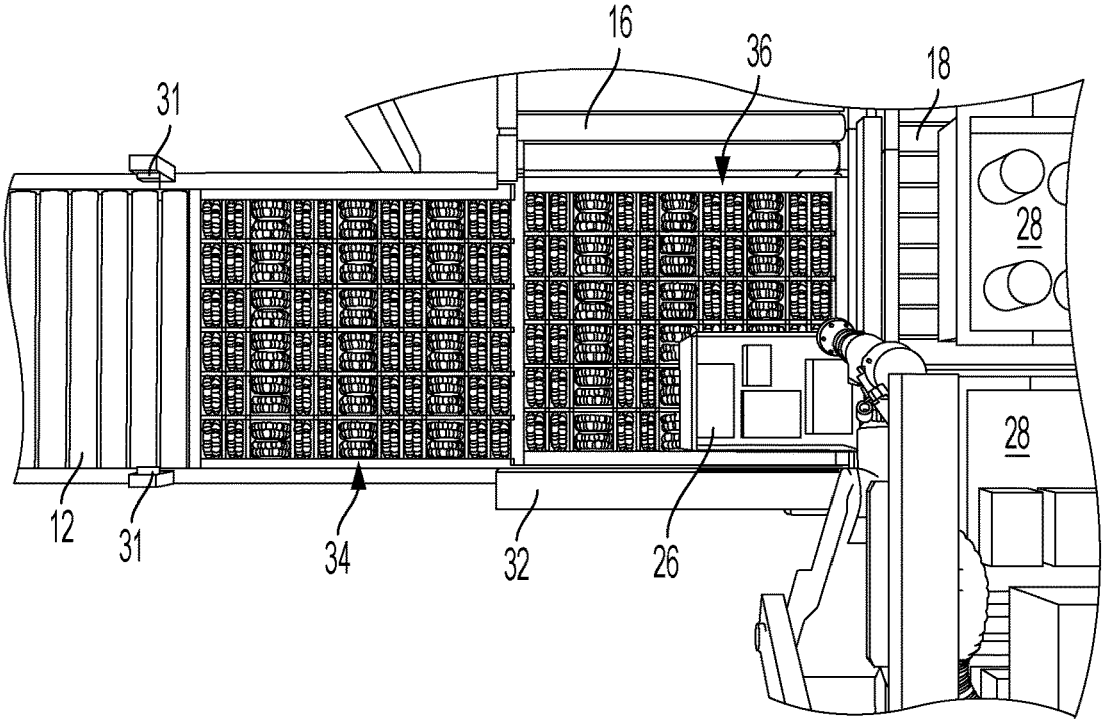

In accordance with further aspects, the invention provides that objects may be packed in a container not in specific assigned locations, but by having settled to a lowest potential energy position. For example, FIG. 17A shows the container 26 with several objects in the container. Some objects overlap others and/or are in a position leaned against an interior wall of the container, all of which may lead to inefficient packing. In accordance with an aspect, the system may elect to agitate the container for the purpose of causing objects therein to settle to a lower potential energy position, and this agitation may include rotating the container. FIG. 17A shows an object leaning against an interior wall of the container wherein the interior wall is proximate the brace corner 40 (shown in FIG. 17B). While the system could move the container 26 away from and back against the braces 30, 32 (shown in FIG. 3), the system may determine that the container should first be rotated (as shown in FIG. 17C) so that the interior wall against which the object is leaning is no longer proximate the brace corner (as shown in FIG. 17D). In this way not only may objects be packed using agitation, the system may elect from which direction any agitation force may contact the container. Where, for example, objects have low pose authority (the ability to maintain a position when placed) the use of such agitation may be particularly helpful.

Figure 18A:
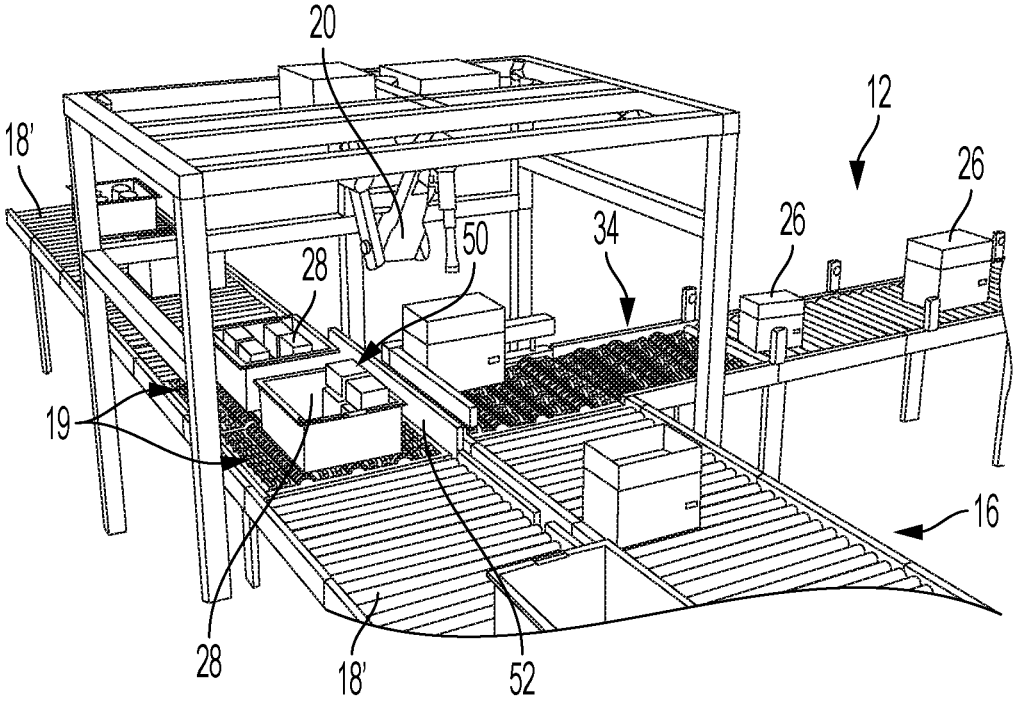
FIGS. 18A-18D show illustrative diagrammatic elevated views of an object processing system in accordance with another aspect of the present invention that includes additional multidirectional units, showing a source container with stacked objects (FIG. 18A), showing the source container being rotated (FIG. 18B), showing the container positioned to jostle the source container (FIG. 18C), and showing the source container having been moved against a brace wall jostling the objects (FIG. 18D).
Figure 18B:
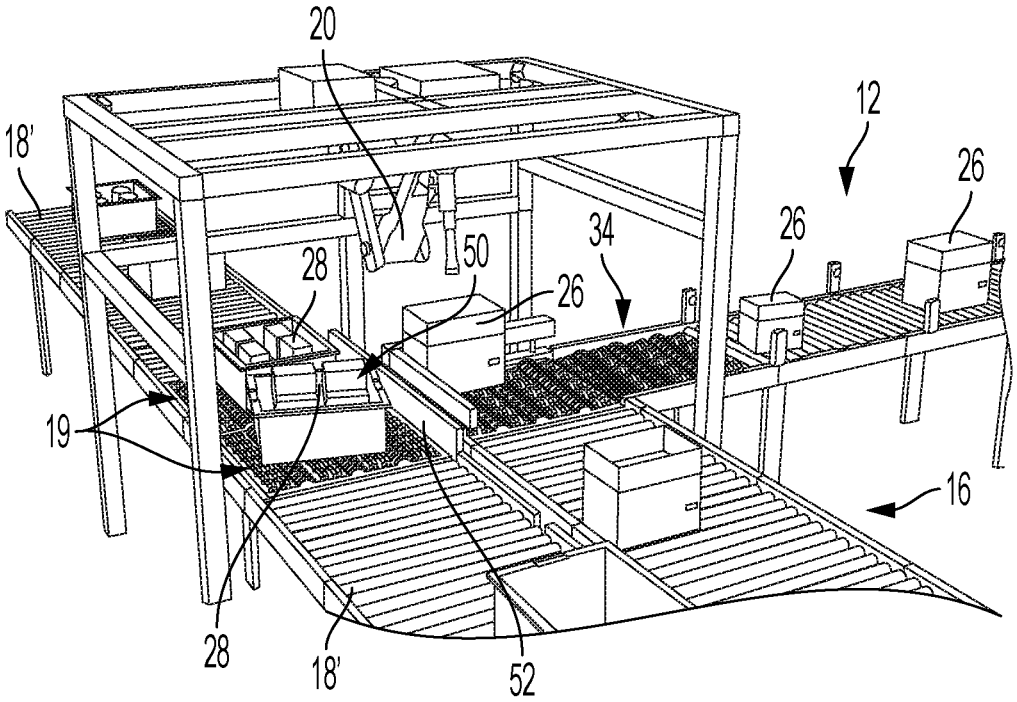
Figure 18C:
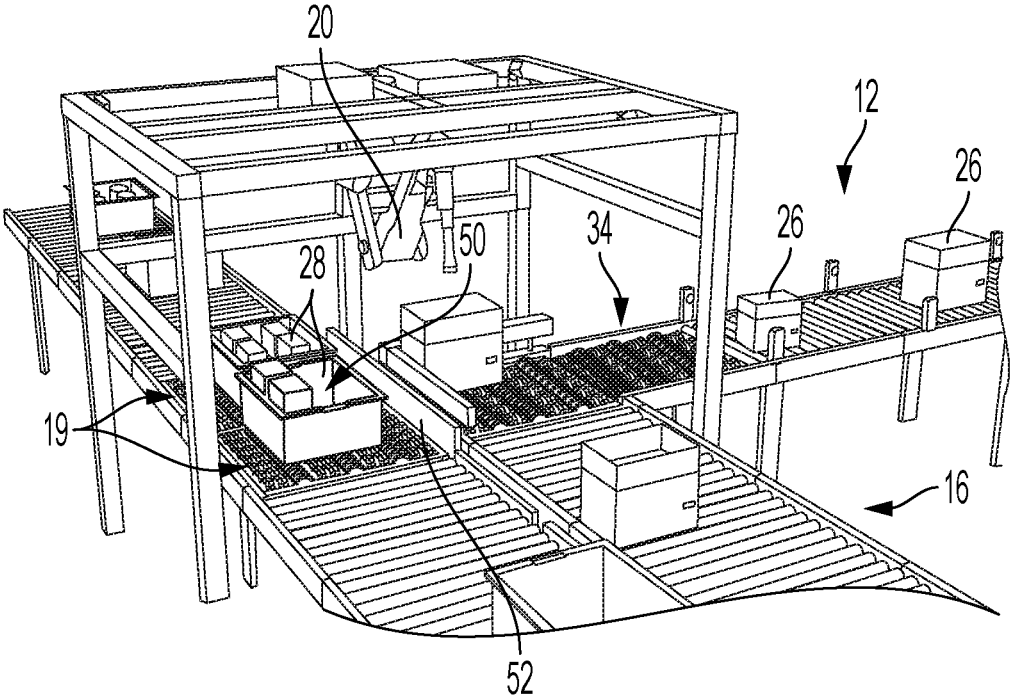
Figure 18D:
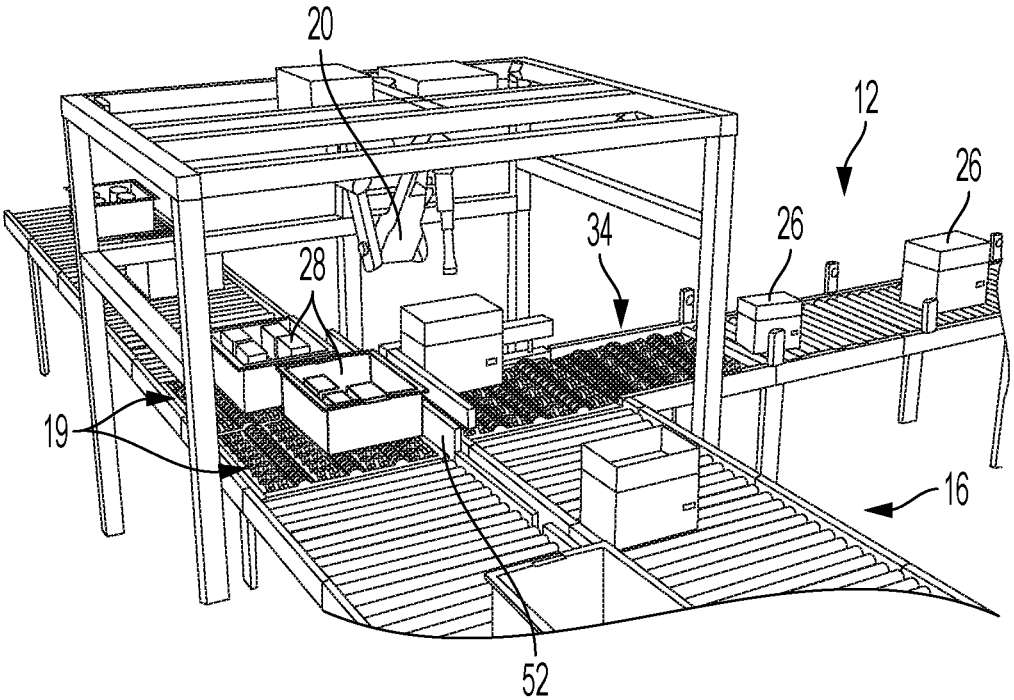

The use of the multidirectional units to manipulate the location and orientation of the containers in the overall packing operation may also be used at the pick location. FIG. 18A shows an object processing system in accordance with a further aspect of the present invention that includes a source conveyor system 18' that includes one or more multidirectional units 19 at the picking locations where objects are picked from source containers 28 by the programmable motion device 20. Certain source objects (as shown at 50) may be underneath other source objects as shown at 50 in FIG. 18A. The system may rotate the source container 28 as shown in FIGS. 18B and 18C using a multidirectional unit 19, and then urge the source container against a brace such as a brace wall 52 at the picking location as shown in FIG. 18D, causing the objects to settle to a lower potential energy position such that none is on top of another within the source container 28. The programmable motion device may then be able to access any of the objects in the source container in any order, providing more efficient packing of the container 26 discussed above. The use of the multidirectional units 19 at the pickling location may also facilitate picking of objects by the programmable motion device that are too close to an interior wall of the source container as discussed above with reference to the container 26 in FIG. 16B.

Those skilled in the art will appreciate that numerous modifications and variations may be made to the above disclosed embodiments without departing from the spirit and scope of the present invention.

What is claimed is:

1. An automated packing system for placing at least one object into a container, said automated packing system comprising:

an input conveyance system for providing empty containers to a packing station;

a multidirectional unit at the packing station for receiving the container and for urging the container against a corner provided by two braces;

a programmable motion device for packing the container with objects provided by source containers; and an output conveyance system for receiving the container from the multidirectional unit following packing.

2. The automated packing system as claimed in claim 1, wherein the automated packing system further includes a weight sensing system on which the multidirectional unit is mounted.

3. The automated packing system as claimed in claim 2, wherein the multidirectional unit includes multiple sets of omnidirectional wheels.

4. The automated packing system as claimed in claim 1, wherein the automated packing system includes a pneumatic system with at least one vacuum cup for securing the container against the corner.

5. The automated packing system as claimed in claim 4, wherein the automated packing system includes a pneumatic system with two vacuum cups for securing two sides of the container against the corner.

6. The automated packing system as claimed in claim 1, wherein the automated packing system includes a securement device on a belt that engages a side of the container to hold the container against the corner.

7. The automated packing system as claimed in claim 6, wherein the securement device is a finger welded to the belt.

8. An automated packing system for placing at least one object into a container, said automated packing system comprising:

an input conveyance system for providing empty containers to a packing station;

a multidirectional unit at the packing station for receiving the container and for urging the container against a corner that includes a pneumatic system for securing the container;

a programmable motion device for packing the container with objects provided by source containers; and an output conveyance system for receiving the container from the multidirectional unit following packing.

9. The automated packing system as claimed in claim 8, wherein the automated packing system further includes a weight sensing system on which the multidirectional unit is mounted.

10. The automated packing system as claimed in claim 9, wherein the multidirectional unit includes multiple sets of omnidirectional wheels.

11. The automated packing system as claimed in claim 8, wherein the pneumatic system includes at least one vacuum cup for securing the container against the corner.

12. The automated packing system as claimed in claim 8, wherein the pneumatic system includes two vacuum cups for securing two sides of the container against the corner.

13. The automated packing system as claimed in claim 8, wherein the automated packing system includes a securement device on a belt that engages a side of the container to hold the container against the corner.

14. The automated packing system as claimed in claim 13, wherein the securement device is a finger welded to the belt.

15. A method of placing at least one object into a container in an automated packing system, said method comprising:

providing container on an input conveyance system to a packing station;

receiving the container at a multidirectional unit at the packing station;

urging the container against a corner provided by two braces;

packing the container with objects provided by source containers using a programmable motion device; and receiving the container at an output conveyance system from the multidirectional unit following packing.

16. The method as claimed in claim 15, wherein the method further includes monitoring a weight on the multidirectional unit.

17. The method as claimed in claim 16, wherein the multidirectional unit includes multiple sets of omnidirectional wheels.

18. The method as claimed in claim 15, wherein the automated packing system includes a pneumatic system with at least one vacuum cup for securing the container against the corner.

19. The method as claimed in claim 18, wherein the automated packing system includes a pneumatic system with two vacuum cups for securing two sides of the container against the corner.

20. The method as claimed in claim 15, wherein the automated packing system includes a securement device on a belt that engages a side of the container to hold the container against the corner.

21. The method as claimed in claim 20, wherein the securement device is a finger welded to the belt.

22. The method as claimed in claim 20, wherein the method further includes rotating the container on the omnidirectional unit prior to urging the container against the corner provided by two braces.

23. The method as claimed in claim 20, wherein the method further includes agitating the container to cause objects therein to settle to a lower potential energy position.

24. The method as claimed in claim 20, wherein the method further includes providing a source container at an input area that includes an input omnidirectional unit for supporting and manipulating the source container.

* * * * *